US005934259A

United States Patent [19]

Onishi

[11] Patent Number: 5,934,259

[45] Date of Patent: Aug. 10, 1999

[54] FUEL INJECTION CONTROL SYSTEM FOR AN INTERNAL COMBUSTION ENGINE

[75] Inventor: Akito Onishi, Nagoya, Japan

[73] Assignee: Toyota Jidosha Kabushiki Kaisha, Toyota, Japan

[21] Appl. No.: 09/047,471

[22] Filed: Mar. 25, 1998

[30] Foreign Application Priority Data

Mar. 31, 1997 [JP] Japan ..... 9-080510

[51] Int. Cl.[6] ..... F02M 51/00

[52] U.S. Cl. ..... 123/491

[58] Field of Search ..... 123/491

[56] References Cited

U.S. PATENT DOCUMENTS

| | | | |
|---|---|---|---|
| 4,515,131 | 5/1985 | Suzuki et al. . | |
| 4,941,449 | 7/1990 | Hoptner et al. | 123/491 |
| 5,390,641 | 2/1995 | Yamada et al. | 123/491 |
| 5,595,161 | 1/1997 | Ott et al. | 123/491 |
| 5,680,846 | 10/1997 | Bauer | 123/491 |
| 5,735,241 | 4/1998 | Matsuura | 123/491 |
| 5,836,288 | 11/1998 | Nakagawa | 123/491 |
| 5,870,986 | 2/1999 | Ichinose | 123/491 |

FOREIGN PATENT DOCUMENTS

| | | |
|---|---|---|
| A-58-25533 | 2/1983 | Japan . |
| B2-2-45018 | 10/1990 | Japan . |
| B2-3-68219 | 10/1991 | Japan . |
| A-6-185387 | 7/1994 | Japan . |
| A-7-103025 | 4/1995 | Japan . |

*Primary Examiner*—John Kwon
*Attorney, Agent, or Firm*—Oliff & Berridge, PLC

[57] ABSTRACT

A fuel injection control system provides a superior start characteristic of an internal combustion engine without deterioration of an exhaust emission. The internal combustion engine has a plurality of cylinders. The fuel injection control system controls a time for injecting fuel into each of the cylinders. A first reference signal is generated each time a crank shaft of the internal combustion engine rotates 360 degrees. A second reference signal is generated each time the crank shaft rotates 720 degrees. A crank angle signal is generated each time the crank shaft rotates a first predetermined angle. Fuel is supplied to the cylinders after the first reference signal is generated for the first time after the internal combustion engine is started. The fuel is sequentially injected into each of the cylinders in a predetermined order in synchronization with a rotation of the crank angle. One of the cylinders in which the fuel supplied by the first asynchronous injection means is consumed for the first time is assumed so as to set the one of the cylinders as a cylinder from which the synchronous injection is started. An assumption of the one of the cylinders is made based on a determination whether the second reference signal is generated while the crank shaft rotates a second predetermined angle after the first reference signal is generated for the first time.

5 Claims, 11 Drawing Sheets

FUEL INJECTION CONTROL SYSTEM FOR AN INTERNAL COMBUSTION ENGINE

BACKGROUND OF THE INVENTION

1. Field of the Invention

The present invention generally relates to a fuel injection control system for an internal combustion engine and, more particularly, to a fuel injection control system which controls a timing for injecting fuel to each of a plurality of engine cylinders.

2. Description of the Related Art

Conventionally, as disclosed in Japanese Patent Publication No.2-45018, a fuel injection control system for an internal combustion engine, which controls the timing for injecting fuel to each of a plurality of engine cylinders, is known. In this system, when a starter switch of the engine is turned on, fuel is injected first to each of the engine cylinders without considering a synchronization with an engine crank angle. Hereinafter, this fuel injecting operation is referred to as an asynchronous injection. In the above-mentioned apparatus, after the starter switch is turned on and the first suction stroke is completed in each of the cylinders, fuel is sequentially injected to each of the cylinders in a predetermined order in synchronization with the crank angle. Hereinafter, this fuel injecting operation is referred to as synchronous injection.

According to the above-mentioned conventional fuel injection control system, fuel is rapidly supplied to a plurality of engine cylinders during a starting operation of the internal combustion engine. Additionally, since the synchronous injection is not started until an intake stroke is completed in each of the cylinders, the fuel supplied by asynchronous injection is prevented from being mixed with the fuel supplied by the synchronous injection. Thus, an air-fuel mixture is prevented from being over-rich.

However, in an internal combustion engine, in order to supply an ignition signal to each of a plurality of engine cylinders at an appropriate time, a condition of each of the cylinders must be accurately determined. The condition of each of the cylinders cannot be detected until a predetermined change has been generated in an angle of a crank shaft after the internal combustion engine is started. Accordingly, the ignition signal cannot be supplied to each of the cylinders until the predetermined change is generated in the crank angle after the internal combustion engine has been started.

As mentioned above, the conventional fuel injection control system performs asynchronous injection for each of the engine cylinders after the starter switch is turned on. After the starting operation of the internal combustion engine is initiated and before the predetermined change is generated in the crank angle, the fuel supplied by asynchronous injection is exhausted without being ignited. In this respect, the above-mentioned conventional fuel injection control system could possibly deteriorate exhaust emissions during a starting operation.

SUMMARY OF THE INVENTION

It is a general object of the present invention to provide an improved and useful fuel injection control system for an internal combustion engine in which the above-mentioned problems are eliminated.

A more specific object of the present invention is to provide a fuel injection control system which can provide a superior starting characteristic for an internal combustion engine without deterioration of exhaust emissions.

In order to achieve the above-mentioned objects, there is provided according to the present invention a fuel injection control system for an internal combustion engine having a plurality of cylinders, the fuel injection control system controlling a time for injecting fuel into each of the cylinders, the fuel injection control system comprising:

first reference signal generating means for generating a first reference signal each time a crank shaft of the internal combustion engine rotates 360 degrees;

second reference signal generating means for generating a second reference signal each time the crank shaft rotates 720 degrees;

crank angle signal generating means for generating a crank angle signal each time the crank shaft rotates a first predetermined angle;

first asynchronous injection means for supplying fuel to the cylinders after the first reference signal is generated for the first time after the internal combustion engine is started;

synchronous injection means for sequentially injecting fuel into each of the cylinders in a predetermined order in synchronization with a rotation of the crank angle;

first start cylinder setting means for assuming one of the cylinders in which the fuel supplied by the first asynchronous injection means is consumed for the first time, and for setting the one of the cylinders as a cylinder from which the synchronous injection is started, an assumption of the one of the cylinders being made based on a determination whether the second reference signal is generated while the crank shaft rotates a second predetermined angle after the first reference signal is generated for the first time.

According to the above-mentioned invention, fuel is supplied to each of the cylinders in response to the first reference signal in asynchronization with the angular position of the crank shaft. A state of each of the cylinders can be determined based on a time when the crank shaft rotates the second predetermined angle after the first reference signal is generated for the first time. In each of the cylinders, an ignition time corresponds to a time when the crank angle changes substantially 360 degrees after an intake stroke is initiated. The second predetermined angle is set to an angle smaller than 360 degrees. Accordingly, the fuel supplied by asynchronous injection in each of the cylinders is not exhausted until a condition of each of the cylinders is determined after asynchronous injection is performed. That is, the fuel supplied by asynchronous injection in each of the cylinders is not exhausted until a condition is established in which an ignition signal can be appropriately supplied to each of the cylinders. Additionally, in the present invention, the synchronous injection is started from a cylinder which firstly consumes the fuel supplied by asynchronous injection. Thus, the fuel supplied by asynchronous injection and the fuel supplied by the synchronous injection are not simultaneously introduced into each of the cylinders. Accordingly, the fuel supplied by asynchronous injection can be prevented from being exhausted without being ignited while the synchronous injection is started without being performed concurrently with the asynchronous injection.

The fuel injection control system according to the present invention may further comprise:

start temperature detecting means for detecting a temperature of the internal combustion engine at a start time;

second asynchronous injection means for supplying fuel to all of the cylinders at a predetermined time after a start operation of the internal combustion engine is initiated, the first asynchronous injection means being ineffective when the second asynchronous injection means is effective;

second start cylinder setting means for assuming one of the cylinders which can intake fuel at the earliest time after the crank shaft rotates the second predetermined angle, and for setting the one of the cylinders as a cylinder from which the synchronous injection is started, the first start cylinder setting means being ineffective when the second start cylinder setting means is effective; and operation switching means for effectuating one of the first asynchronous injection means and the second asynchronous injection means which can supply fuel earlier when the temperature of the internal combustion engine is lower than a predetermined temperature at the start time, and for effectuating the second start cylinder setting means instead of the first start cylinder setting means when the temperature of the internal combustion engine is lower than the predetermined temperature at the start time.

According to this invention, when the temperature of the internal combustion engine is low, the asynchronous injection is performed by one of the first asynchronous injection means and the second asynchronous injection means. Specifically, the asynchronous injection is performed at one of a predetermined time after the starting operation of the internal combustion engine is initiated and a time when the first reference signal is generated whichever comes first. In order to obtain a good starting characteristic of the internal combustion engine, it is advantageous to perform the asynchronous injection at an earlier time after the starting operation is initiated. According to this invention, the above-mentioned requirement can be satisfied when the temperature of the internal combustion engine is low at the start time. Additionally, when the temperature of the internal combustion engine is low, the cylinder from which the synchronous injection is started is set by the second start cylinder setting means. The second start cylinder setting means sets one of the cylinders in which a suction stroke is performed at the earliest time after the condition is established for determining the state of each of the cylinders. In this case, the synchronous injection is rapidly started after the starting operation of the internal combustion engine is initiated.

In one embodiment of the present invention, the crank angle signal generating means generates the crank angle signal each time the crank shaft rotates 30 degrees. Additionally, the first reference signal generating means comprises a crank angle sensor detecting an angular position of the crank shaft, and the second reference signal generating means comprises a cam position sensor detecting a predetermined angular position of a cam shaft of the internal combustion engine.

Other objects, features and advantages of the present invention will become more apparent from the following detailed description when read in conjunction with the accompanying drawings.

DETAILED DESCRIPTION OF THE PREFERRED EMBODIMENTS

Figure 1:
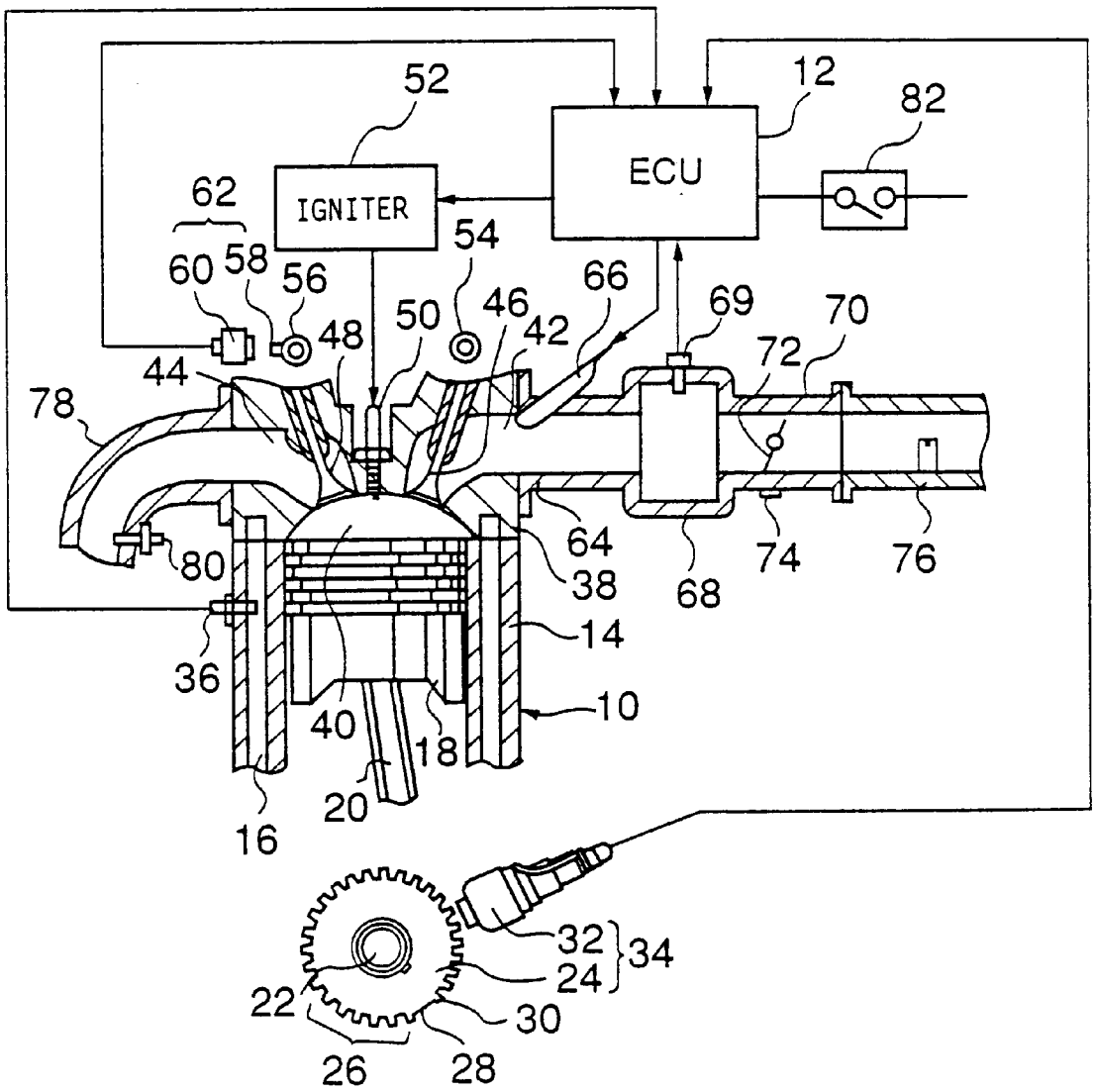
FIG. 1 is a system diagram of an internal combustion engine which is provided with a fuel injection control system according to a first embodiment of the present invention.

A description will now be given, with reference to FIG. 1, of a first embodiment of the present invention. FIG. 1 is a system diagram of an internal combustion engine 10 which is provided with a fuel injection control system according to the first embodiment of the present invention.

The internal combustion engine 10 is controlled by an electronic control unit 12 (hereinafter referred to as ECU 12). The internal combustion engine 10 includes a cylinder block 14 in which a water jacket 16 is formed. Six engine cylinders (cylinders #1 to #6) are formed inside the water jacket 16. A piston 18 and a connecting rod 20 is provided in each of the cylinders. The connecting rod 20 provided in each of the cylinders is connected to a crank shaft 22.

The six engine cylinders of the internal combustion engine 10 are classified in three groups according to a phase of movement of the corresponding piston 18. It is assumed that the piston #1 and the piston #6 are classified in a first group; the piston #2 and the piston #5 are classified in a second group; and the piston #3 and the piston #4 are classified in a third group. In the internal combustion engine 10, the pistons 18 classified in the same group are reciprocated in the same phase, and the pistons 18 classified in different groups are reciprocated with a phase difference of $2\pi/3$ from each other. Additionally, two pistons 18 classified in the same group are reciprocated so that a complete cycle, which includes an intake stroke, a compression stroke, an explosion stroke and an exhaust stroke, are performed with a phase difference of 360 degrees with respect to an angle of the crank shaft 22 (360° CA).

A rotor 24 is fixed to the crank shaft 22. The outer surface of the rotor 24 is formed with a tooth portion 26 and a tooth cutout portion 28. A plurality of teeth 30 are formed over the entire tooth portion 26, the teeth being arranged at a predetermined interval. On the other hand, a tooth is not formed in the tooth cutout portion 28 over a predetermined length.

A pick-up sensor 32 is provided at a position opposite to the rotor 24 so as to sense a rotation of the rotor 24. When the rotor 24 rotates, the teeth of the teeth 30 of the rotor 24 repeatedly pass the pick-up sensor 32. The pick-up sensor 32 outputs pulse signals in synchronization with the approach and passing of the teeth 30. Hereinafter, the rotor 24 and the pick-up sensor 32 together are referred to as a crank angle sensor 34.

The crank angle sensor 34 outputs a single pulse signal each time the crank shaft 22 rotates 10 degrees (10° CA) when the pick-up sensor 32 faces the tooth portion 26. Hereinafter, this pulse signal is referred to as a crank angle signal. On the other hand, when the pick-up sensor 32 faces the tooth cutout portion 28, the crank angle sensor 34 does not output the crank angle signal. In the present embodiment, the tooth cutout portion 28 corresponds to 30 degrees (30° CA) in the rotation of the crank shaft 22. That is, when the tooth cutout portion 28 approaches and passes the pick-up sensor 32, the crank angle signal is output when the crank shaft 22 is rotated 30 degrees (30° CA) after the immediately preceding crank angle signal is output before the pick-up sensor 32 faces the tooth cutout portion 28. Hereinafter, the crank angle signal which is output immediately after the passage of the tooth cutout portion 28 is referred to as a tooth cutout signal. In the internal combustion engine 10, the crank angle sensor 34 outputs the tooth cutout signal when the piston 18 of cylinder #1 or cylinder #6 reaches a position corresponding to a crank angle 150 degree before the top dead center (TDC). Hereinafter, this crank angle is referred to as 150° BTDC.

A water temperature sensor 36 is provided on a wall of the cylinder block 14. The water temperature sensor 36 outputs an electric signal corresponding to a temperature of coolant flowing in the water jacket 16. The signal output from the water temperature sensor 36 is supplied to the ECU 12. The ECU 12 detects a temperature THW of the coolant based on the signal output from the water temperature sensor 36.

A cylinder head 38 is fixed to a top of the cylinder block 14 so that combustion chambers 40 are defined by the cylinder head 38 and each of the pistons 18. The cylinder head 38 is provided with intake ports 42 and exhaust ports 44 which are connected to the respective combustion chambers 40. Each of the intake ports 42 is opened and closed by an intake valve 46. Each of the exhaust ports 44 is opened and closes by an exhaust valve 48. Additionally, ignition plugs 50 are provided to the cylinder head 38 so that an end of each of the ignition plugs 50 is exposed to the corresponding combustion chamber 40.

Each of the ignition plugs 50 is connected to an igniter 52 which is connected to the ECU 12. The ECU 12 supplies an ignition signal to the igniter 52 at a time when an ignition should be performed in one of the cylinders 18. The igniter 52 supplies a high-voltage ignition signal to the ignition plug 50 of each of the cylinder #1 and the cylinder #6 belong to the first group in synchronization with a time of supply of the ignition signal from the ECU 12. Similarly, the igniter 52 supplies a high-voltage ignition signal to the ignition plug 50 of each of the cylinder #2 and the cylinder #5 belong to the second group in synchronization with a time of supply of the ignition signal from the ECU 12. The igniter 52 also supplies a high-voltage ignition signal to the ignition plug 50 of each of the cylinder #3 and the cylinder #4 belong to the third group in synchronization with a time of supply of the ignition signal from the ECU 12.

A cam shaft 54 and a cam shaft 56 are provided in the cylinder head 38. The cam shafts 54 and 56 are coupled to the crank shaft 22 via a timing belt (not shown in the figure) so that the cam shaft 54 drives each intake valve 46 and the cam shaft 56 drives each exhaust valve 48. The cam shafts 54 and 56 are rotated at a speed one half of a rotational speed of the crank shaft 22. Cams are formed on each of the cam shafts 54 and 56 so as to open and close the intake valve 46 and the exhaust valve 48 in each of the cylinders 18. The intake valve 46 and the exhaust valve 48 in each of the cylinders 18 are opened and closed one time for each single rotation of the cam shafts 54 and 56, that is, for each 720 degree change in the crank angle of the internal combustion engine 10.

The cam shaft 56 which drives each exhaust valve 48 is provided with a protrusion 58. A pick-up sensor 60 is provided near the protrusion 58. Hereinafter, the combination of the protrusion 58 and the pick-up sensor 60 is referred to as a cam position sensor 62. The cam position sensor 62 outputs a single pulse signal when the cam shaft 56 makes a complete turn. The signal output from the cam position sensor is provided to the ECU 12. The ECU 12 detects a crank angle of the internal combustion engine 10 based on the signal output from the cam position sensor 62 and the signal output from the crank angle sensor 34.

An intake manifold 64 is connected to each intake port 42 of the internal combustion engine 10. The manifold 64 is provided with an injector 66 to which fuel is supplied via a fuel pipe (not show in the figure). The injector 66 opens so as to inject fuel in the intake port 64 during a period when a drive signal is supplied from the ECU 12.

The intake manifold 64 is connected to an intake pipe 70 via a surge tank. The surge tank is provided with an intake air temperature sensor 69 which detects temperature of air flowing in the surge tank 68. A signal output from the intake air temperature sensor 69 is provided to the ECU 12. The ECU 12 determines an intake air temperature (THA) of the internal combustion engine 10 based on the signal output from the intake air temperature sensor 69.

The intake pipe 70 is provided with a throttle valve 72 which operates in association with an acceleration pedal. A throttle sensor 74 is provided adjacent to the throttle valve 72 so as to output an electric signal corresponding to a degree of opening of the throttle valve 72. Additionally, an air flow meter 76 is connected to the intake pipe 70. The air flow meter 76 is connected to an air filter (not shown in the figure). The air flow meter 76 outputs an electric signal corresponding to a mass weight of air flowing through the air flow meter 76 via an air filter. Hereinafter, the mass weight of air suctioned into the internal combustion engine 10 is referred to as an amount of intake air G.

An exhaust manifold 78 is connected to each exhaust port 44 of the internal combustion engine 10. The exhaust manifold 78 is provided with an oxygen ($O_2$) sensor 80. The $O_2$ sensor outputs an electric signal corresponding to a concentration of oxygen contained in an exhaust gas flowing through the exhaust manifold 78.

The internal combustion engine 10 is provided with a starter switch 82 which is connected to a starter motor (not shown in the figure). The starter switch 82 is turned on so as to start the internal combustion engine 10. The starter switch 82 is connected to the ECU 12. The ECU 12 detects a status of operation of the starter motor based on whether the starter switch 82 is turned on.

As mentioned-above, the ECU 12 detects crank angle of the internal combustion engine 10 based on the signal output from the cam position sensor 62 and the signal output from the crank angle sensor 34. Additionally, the ECU 12 controls a time for injecting fuel to the cylinders #1 to #6 based on the crank angle of the internal combustion engine 10.

Figure 2:
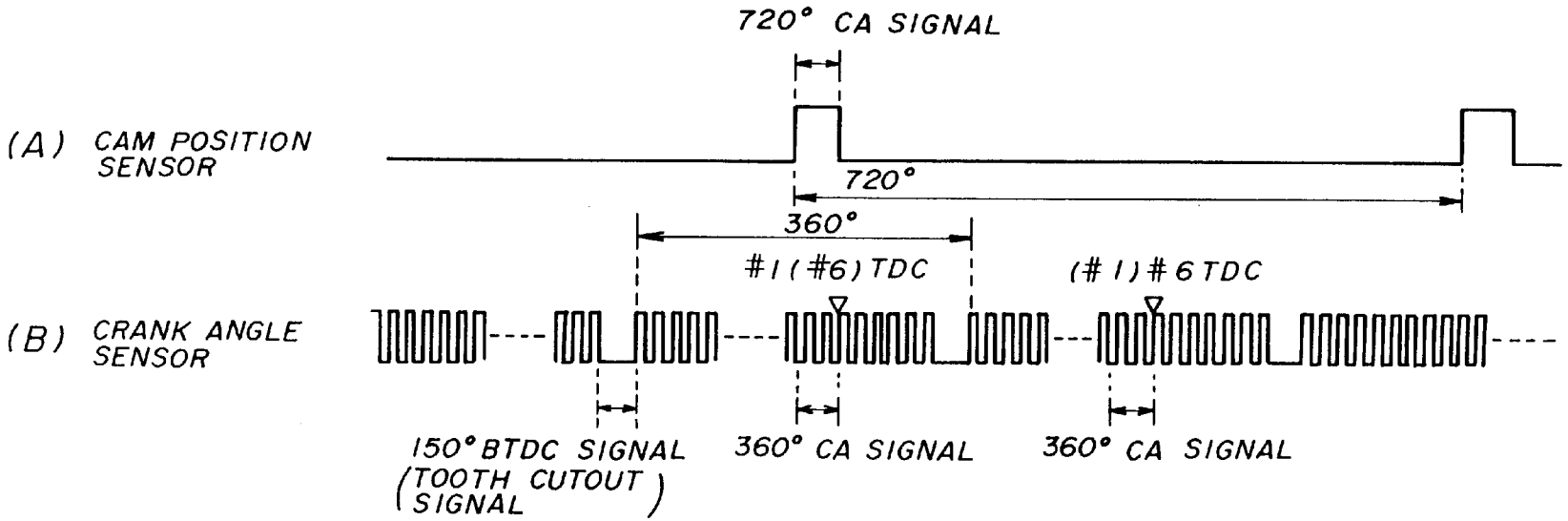
FIG. 2 is a waveform chart of signals output from a cam position sensor and a crank angle sensor shown in FIG. 1.

FIG. 2 is a waveform chart of the signals output from the cam position sensor 62 and the crank angle sensor 34. FIG. 2-(A) shows a change in the signal output from the cam position sensor 62, and the FIG. 2-(B) shows a change in the signal output from the crank angle sensor 34. The ECU 12 divides the crank angle signal of the crank angle sensor 34 which is output each time the crank angle changes 10 degrees so as to produce a signal which is generated each time the crank angle changes 30 degrees, similar to the tooth cutout signal. Hereinafter, this signal and the tooth cutout signal together are representatively referred to as a 30° CA signal. In the present embodiment, a time for injecting fuel in the internal combustion engine 10 is controlled based on the 30° CA signal.

As mentioned above, the crank angle sensor 34 outputs the tooth cutout signal when the crank angle reaches 150° BTDC. Thus, the ECU 12 determines that the crank angle is at 150° BTDC when the tooth cutout signal is supplied by the crank angle sensor 34. The ECU 12 then determines that the crank angle reaches an angle at which the piston 18 of each of the cylinders #1 and #6 are at the top dead center TDC when five 30° CA signals are detected after the detection of the tooth cutout signal.

It should be noted that, in the following description, as shown in FIG. 2-(B), the 30° CA signal which is detected at a time when the crank angle reaches 150° BTDC is referred to as a 150° BTDC signal, and the 30° CA signal which is detected at a time when the piston 18 of each of the cylinders #1 and #6 reaches the top dead center is referred to as a 360° CA signal.

The cam position sensor 62 outputs one pulse signal each time the crank angle changes 720 degrees. Hereinafter, this pulse signal is referred to as a 720° CA signal. In the present embodiment, as shown in FIG. 2-(A) and FIG. 2-(B), the cam position sensor 62 outputs the pulse signal in synchronization with the time when the 360° CA signal is output.

In the internal combustion engine 10, the 720° CA signal is output from the cam position sensor 62 when the piston 18 in the cylinder #1 is moved to the top dead center TDC while the piston 18 in the cylinder #1 performs a compression stroke, that is, when the piston 18 in the cylinder #6 is moved to the top dead center while the piston 18 in the cylinder #6 performs an intake stroke. Accordingly, if the 360° CA signal and the 720° CA signal are detected substantially at the same time, it can be determined that the piston 18 in the cylinder #1 reaches the top dead center of the compression stroke (hereinafter referred to as a compression TDC) and the piston 18 in the cylinder #6 reaches the top dead center of the intake stroke (hereinafter referred to as a suction TDC). Additionally, when the 360° CA signal is detected alone, it can be determined that the piston 18 in the cylinder #1 reaches the suction TDC and the piston 18 in the cylinder #6 reaches the compression TDC.

In the six cylinders #1 to #6 of the internal combustion engine 10, the same stroke is sequentially performed each time the crank angle changes by $2\pi/3$. Specifically, when an intake stroke is started in the cylinder #1, an intake stroke is sequentially started in other cylinders in the order of #1→#5→#3→#6→#2→#4→#1. Accordingly, if it is detected that the piston 18 in the cylinder #1 or the piston 18 in the cylinder #6 is at the suction TDC, it can be accurately determined what the state of each of the other cylinders is and how the state of each of the other cylinders will be changed in relation to a subsequent change in the crank angle. Accordingly, the ECU 12 can determine the state of each of the cylinders #1 to #6 when the piston 18 in the cylinder #1 or the piston 18 in the cylinder #6 is detected at the suction TDC, that is, when the 360° CA signal is detected for the first time after a starting operation of the internal combustion engine 10 is initiated.

A description will now be given, with reference to FIGS. 3 through 6, of a fuel injection control operation performed in the internal combustion engine 10.

Figure 3:
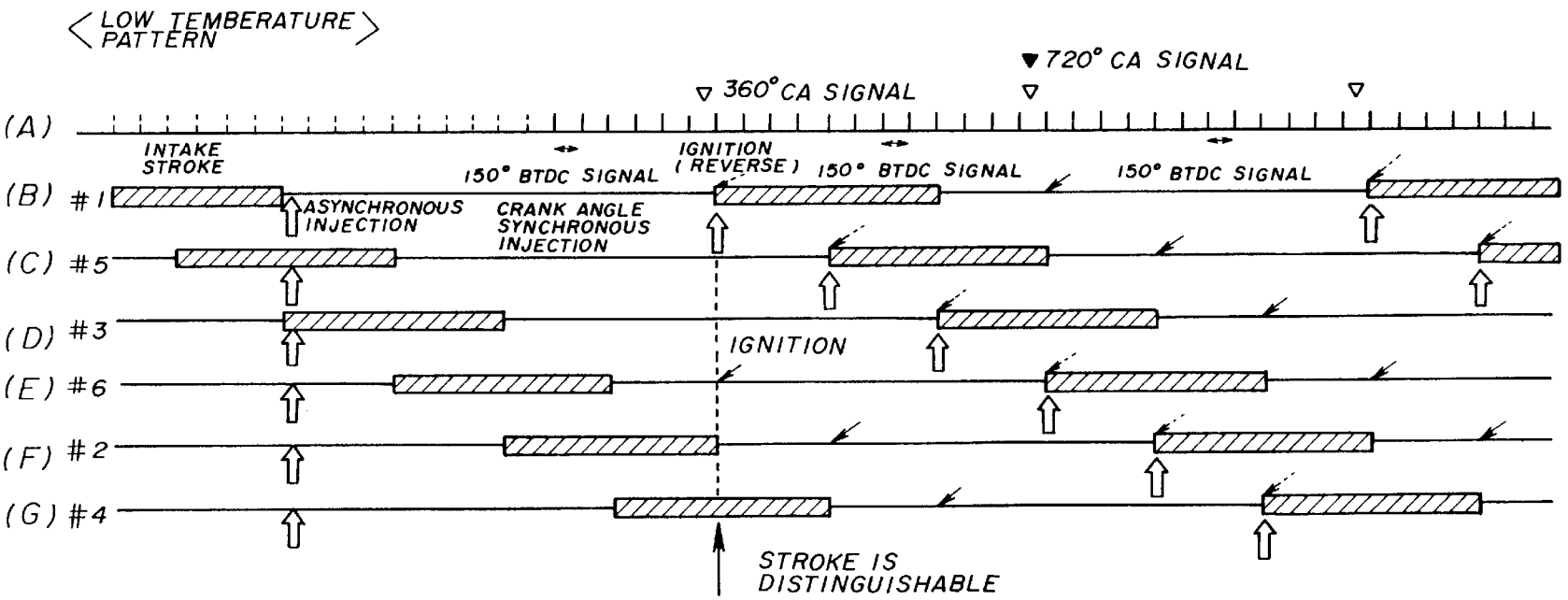
FIG. 3 is a time chart for explaining a fuel injection control operation performed when the internal combustion engine shown in FIG. 1 is at an extremely low temperature in a starting operation.

FIG. 3 is a time chart for explaining the fuel injection control operation performed when the internal combustion engine 10 is at an extremely low temperature in a starting operation. Specifically, FIG. 3-(A) indicates a timing for generating the 30° CA signal; FIG. 3-(B) indicates a timing for performing an intake stroke, a timing for an ignition and a timing for injecting fuel in the cylinder #1; FIG. 3-(C) indicates a timing for performing an intake stroke, a timing for ignition and a timing for injecting fuel in the cylinder #5; FIG. 3-(C) indicates a timing for performing an intake stroke, a timing for an ignition and a timing for injecting fuel in the cylinder #3; FIG. 3-(D) indicates a timing for performing an intake stroke, a timing for ignition and a timing for injecting fuel in the cylinder #6; FIG. 3-(E) indicates a timing for performing an intake stroke, a timing for an ignition and a timing for injecting fuel in the cylinder #2; FIG. 3-(F) indicates a timing for performing an intake stroke, a timing for ignition and a timing for injecting fuel in the cylinder #2; FIG. 3-(G) indicates a timing for performing an intake stroke, a timing for ignition and a timing for injecting fuel in the cylinder #4. It should be noted that a time indicated by a dotted line in FIG. 3-(A) indicates a time when the 30° CA signal is generated after the internal combustion engine 10 is started and before a 150° BTDC signal (first 150° BTDC signal) is detected for the first time.

When a temperature of the internal combustion engine 10 is low during a starting operation, it is difficult for the fuel supplied to the intake port 42 to be evaporated. Accordingly, in order to maintain a good start characteristic in such a condition, it is appropriate to compensate for a deterioration in the volatility of fuel by supplying the fuel into each of the cylinders immediately after the starting operation of the internal combustion engine 10 is initiated.

When the temperature of the engine 10 is low, the ECU 12 performs the asynchronous injection for each of the cylinders after waiting for passage of a predetermined period that is needed for increasing an engine speed NE to a predetermined level. Hereinafter, this asynchronous injection is referred to as an ST asynchronous injection.

In FIG. 3, hatched arrows indicate a time for performing the ST asynchronous injection. The time chart shown in FIG. 3 shows a case in which the ST asynchronous injection is performed at the same time the intake stroke of the cylinder #1 is completed after the starting operation of the internal combustion engine 10 is initiated. Fuel can be supplied to the intake port 42 of each of the cylinders 18 immediately after the starting operation of the internal combustion engine 10 is initiated by performing asynchronous injection according to such a method.

In order to supply an ignition signal to the ignition plug 50 of each of the cylinders 18 at an appropriate timing, and in order to supply fuel to each of the cylinders for synchronous injection at an appropriate timing, a state of each of the cylinders must be determined. The ECU 12 can determine the state of each of the cylinders when the 360° CA signal (first 360° CA signal) is detected for the first time after the starting operation of the internal combustion engine 10 is initiated. Accordingly, the internal combustion engine 10 is set to a state in which the ignition control and synchronous injection can be started when the first 360° CA signal is detected after the initiation of the starting operation of the internal combustion engine 10.

In the time chart shown in FIG. 3, the 360° CA signal which is detected for the first time after the start of the internal combustion engine 10 is detected alone. In this case, the ECU 12 determines that the piston 18 in the cylinder #6 reaches the compression TDC and the piston 18 in the cylinder #1 reaches the suction TDC after the first 360° CA signal is detected.

When the piston 18 in the cylinder #1 reaches the suction TDC, the cylinder #1 suctions the fuel supplied to the intake port 42 at the earliest time. That is, when the internal combustion engine 10 is started along the time chart shown in FIG. 3, the cylinder #1 can be provided with fuel by synchronous injection at the earliest time among the cylinders of the internal combustion engine 10.

It is possible that the first 360° CA signal is detected substantially at the same time the 720° CA signal is detected. In such a case, the ECU 12 determines that the piston 18 in the cylinder #1 reaches the compression TDC and the piston 18 in the cylinder #6 reaches the suction TDC when the first 360° CA signal is detected. In such a condition, the cylinder #6 can be provided with fuel by synchronous injection at the earliest time.

Blank arrows in FIG. 3 indicate a time for performing synchronous injection for each of the cylinders in the internal combustion engine 10. In the present embodiment, when a temperature of the internal combustion engine 10 is extremely low, the synchronous injection is started from one of the cylinders #1 to #6 which can be provided with the fuel at the earliest time when the first 360° CA signal is detected after the starting operation of the internal combustion engine 10 is initiated. Specifically, synchronous injection is started in one of the cylinders #1 and #6 in which an intake stroke is being started at that time. Thereafter, the ECU 12 sequentially supplies fuel to the cylinders of the internal combustion engine 10 in a predetermined order each time the crank angle changes $2\pi/3$ (120°).

It is possible that a predetermined time before the start of the intake stroke in each of the cylinders may be set as a time for supplying fuel to each of the cylinders in the internal combustion engine 10. However, in the internal combustion engine 10, the time when the 360° CA signal is detected and the time when the intake stroke is started in the cylinder #1 or #6 is set to substantially the same time. Accordingly, if the time for supplying fuel by synchronous injection is set to a predetermined time before the intake stroke is started in each of the cylinders, synchronous injection cannot be performed with respect to the cylinders #1 and #6 when the first 360° CA signal is detected after the internal combustion engine 10 is started.

Accordingly, in the present embodiment, when the temperature of the internal combustion engine is extremely low, one of the cylinders #1 to #6 is set to be the one from which the synchronous injection is started. Additionally, the time for supplying fuel by synchronous injection is set to the time when the 360° CA signal is detected with respect to the cylinders of the first group; the time for supplying fuel by the synchronous injection is set to the time when a change $2\pi/3$ is generated in the crank angle after the 360° CA signal is detected with respect to the cylinders of the second group; the time for supplying fuel by the synchronous injection is set to the time when a change $4\pi/3$ is generated in the crank angle after the 360° CA signal is detected with respect to the cylinders of the third group. Accordingly, when the internal combustion engine 10 is started at an extremely low temperature, synchronous injection can be rapidly performed. It should be noted that, in the present embodiment, the timing for performing the synchronous injection is maintained until the starter switch 82 is turned off.

In the internal combustion engine 10, the ignition control is started when the first 360° CA signal is detected similar to the synchronous injection. Specifically, when the first 360° CA signal is detected, the ECU 12 determines that the pistons of the cylinders #1 and #6 are at their top dead center and, thus, an ignition signal is supplied to the igniter 52. As a result, an ignition signal is provided to the ignition plug 50 of each of the cylinders #1 and #6. Thus, an ignition is performed in the cylinders #1 and #6.

Thereafter, the ECU 12 and the igniter 52 provide the ignition signal to the ignition plugs 50 in an order that the ignition plugs 50 of the first group→ the ignition plugs 50 of the second groups→ the ignition plugs 50 of the third group→ the ignition plugs of the first group, each time the crank angle changes $2\pi/3$ that is each time one of the cylinders 18 reaches the compression TDC.

According to the above-mentioned process, fuel can be supplied to each of the cylinders by asynchronous injection and synchronous injection immediately after the starting operation of the internal combustion engine 10 is initiated while an appropriate ignition is performed to the fuel introduced into the combustion chamber of each of the cylinders. Thus, the internal combustion engine 10 is provided with an appropriate start characteristic even when the temperature of the internal combustion engine 10 is extremely low at the start time.

Figure 4:
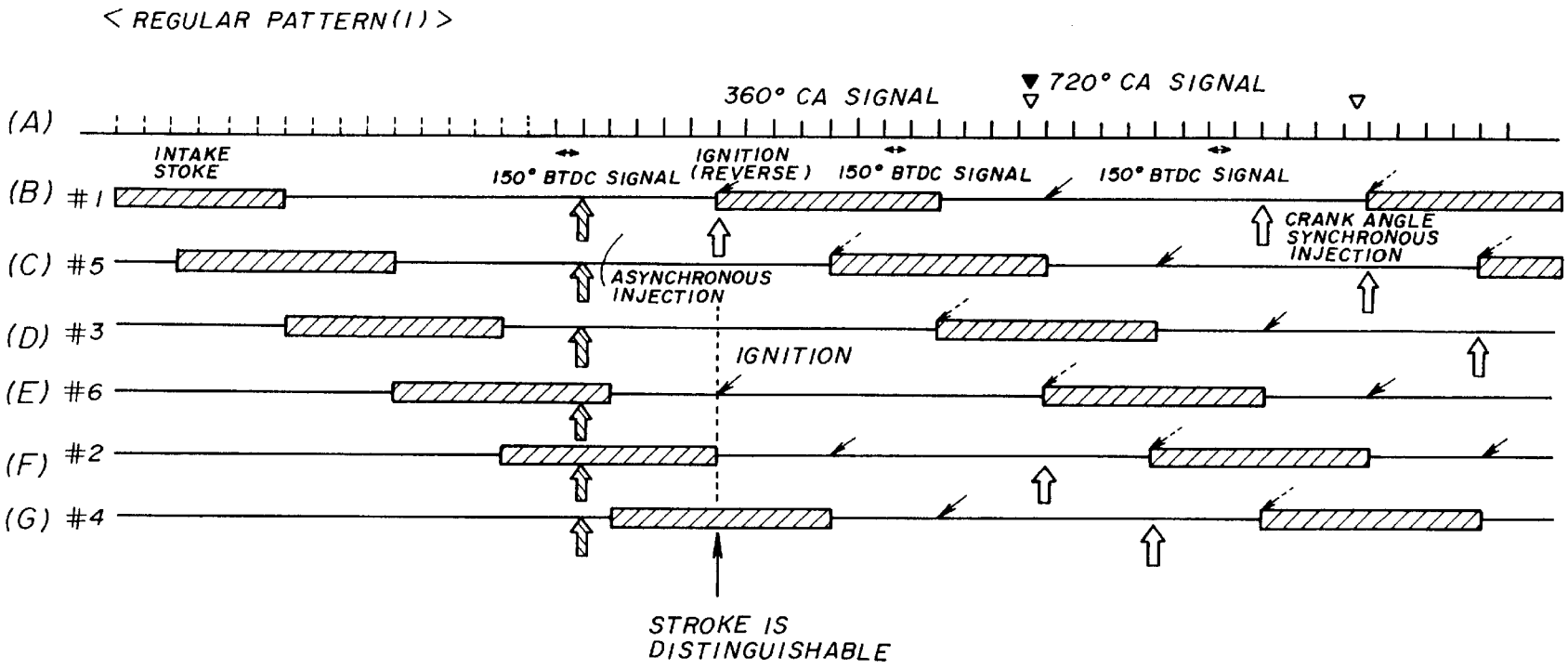
FIG. 4 is a time chart for explaining a fuel injection control operation when the internal combustion engine shown in FIG. 1 is at a room temperature during a starting operation.
Figure 5:
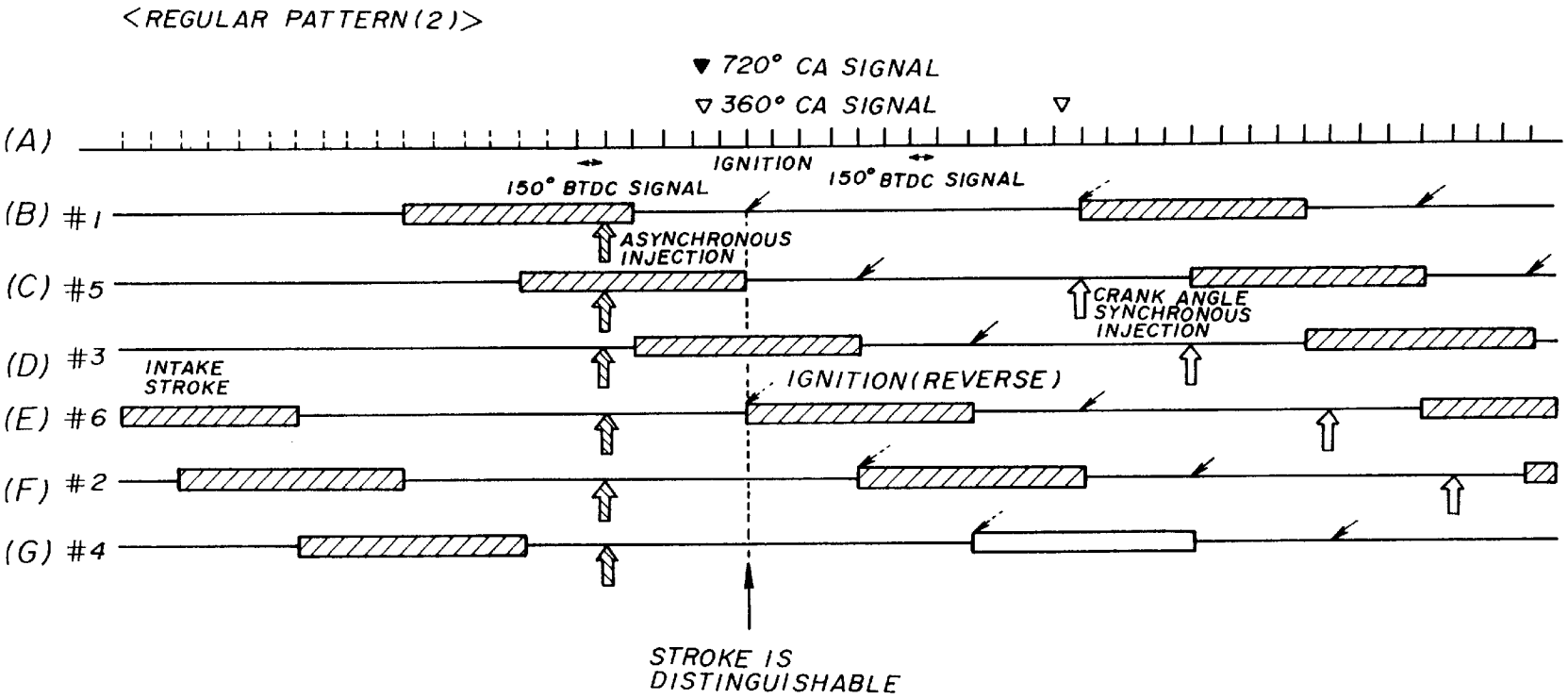
FIG. 5 is a time chart for explaining a fuel injection control operation when the internal combustion engine shown in FIG. 1 is at a room temperature during a starting operation.

FIGS. 4 and 5 are time charts for explaining a fuel injection control operation when the internal combustion engine 10 is at room temperature during a starting operation. Specifically, the time chart of FIG. 4 shows an operation performed when the first 150° BTDC signal after the start of the engine is detected and immediately before an intake stroke in the cylinder #6 is completed. Additionally, the time chart of FIG. 5 shows an operation performed when the first 150° BTDC signal after the start of the engine is detected immediately before an intake stroke in the cylinder #1 is completed. It should be noted that, similar to FIG. 3, FIG. 4-(A) through FIG. 4-(G) and FIG. 5-(A) through FIG. 5-(G) indicate a time for generating the 30° CA signal and a time for performing the intake stroke in each of the cylinders #1, #5, #3, #6, #2 and #4, respectively.

When the internal combustion engine 10 is started along with the operation indicated by the time chart shown in FIG. 3, the fuel supplied by asynchronous injection during an intake stroke performed immediately after the detection of the first 360° CA signal and the fuel supplied by synchronous injection may be introduced into the combustion chamber at the same time. If the temperature of the internal combustion engine 10 is extremely low, the air-fuel mixture introduced into the combustion chamber 40 does not become over-rich, even if such a condition happens, since volatility of the fuel is low. However, if the internal combustion engine 10 is at a normal temperature during the starting operation and if the same fuel injection control is performed under a condition in which the fuel exhibits a good volatility, the air-fuel mixture introduced into the combustion chamber 40 may become over-rich in the cylinder #1.

Additionally, when the internal combustion engine 10 is started along with the operation indicated by the time chart shown in FIG. 3, the fuel supplied by asynchronous injection may be immediately introduced into the combustion chamber 40 in the cylinders #5 and #3. In the time chart shown in FIG. 3, after asynchronous injection is performed, an exhaust stroke is performed before an ignition is performed in the cylinders #5 and #3.

If the temperature of the internal combustion engine 10 is extremely low during the starting operation, the fuel is not introduced into the cylinders #3 and #5 even if asynchronous injection is performed at the above-mentioned timing since the volatility of the fuel is low. Thus, if the temperature of the internal combustion engine 10 is extremely low, a large deterioration in an exhaust emission can be prevented from being generated. However, when the fuel injection control operation is performed if the internal combustion engine 10 is at a normal temperature when the starting operation is performed in which the fuel exhibits a good volatility, the exhaust emission of the internal combustion engine 10 may be deteriorated during the starting operation since the fuel supplied by the asynchronous injection is exhausted without being combusted.

As discussed above, in the internal combustion engine 10, an appropriate control cannot be performed when the fuel injection control operation is performed in a condition in which the engine is at a normal temperature during the starting operation, if the fuel injection control operation is performed in the same manner as the operation performed when the temperature of the engine is extremely low during the starting operation. In order to avoid such a problem, when the temperature of the internal combustion engine 10 is at a normal temperature during the starting operation, the ECU 12 performs the fuel injection control operation by a different method from the method performed when the temperature of the engine is extremely low during the starting operation.

As shown in FIGS. 4 and 5, when the internal combustion engine 10 is at a normal temperature when it is started, the ECU 12 provides a control to supply fuel to each of the cylinders by asynchronous injection at the time when the first 150° BTDC signal is detected after the starting operation of the internal combustion engine 10 is initiated. Hereinafter, this asynchronous injection is referred to as an NE asynchronous injection.

The NE asynchronous injection is performed immediately before an intake stroke is completed in the cylinder #6 as shown in FIG. 4, or immediately before an intake stroke is completed in the cylinder #1 as shown in FIG. 5. Accordingly, the fuel supplied to the cylinders #6 and #1 by the NE asynchronous injection barely introduced into combustion chamber 40 of each of the cylinders #6 and #1 at a stage immediately after the injection. As shown in FIGS. 4 and 5, the NE asynchronous injection is performed in an initial stage of an intake stroke in the cylinder #2 (FIG. 4), or in an initial stage of an intake stroke in the cylinder #5 (FIG. 5). Accordingly, when the internal combustion engine 10 is operated with the sequence indicated by the time chart shown in FIG. 4, The fuel supplied by the NE asynchronous injection is introduced into the combustion chamber 40 of the cylinder #2 at a stage immediately after the injection. In this case, the cylinder to which the fuel is supplied by the NE asynchronous injection for the first time is the cylinder #2. Similarly, when the internal combustion engine 10 is operated in the sequence indicated by the time chart of FIG. 5, the cylinder to which the fuel is supplied by the NE asynchronous injection for the first time is the cylinder #5.

When the internal combustion engine 10 is operated along the sequence indicated by the time chart shown in FIG. 4 or FIG. 5, ignition in each of the cylinders is performed in the same manner as is in the case where the internal combustion engine 10 is operated in the sequence indicated by the time chart shown in FIG. 3. That is, in the internal combustion engine 10, ignition is performed in the cylinders of the first group at the time when the first 360° CA signal is detected after the engine is started. Thereafter, an ignition is performed sequentially in the order "the first group→ the second group→ the third group" each time the $2\pi/3$ change is generated in the crank angle.

As mentioned above, when the internal combustion engine 10 is operated along with the sequence indicated by the time chart shown in FIG. 4 or FIG. 5, the fuel supplied by the NE asynchronous injection at the time when the first 150° BTDC signal is detected is introduced first into the cylinder #2 or #5. Then, a control of ignition is started at the time when a change of 150 degrees is generated in the crank angle after the NE asynchronous injection is performed. Thereafter, ignition is preformed in the cylinders #2 and #5 at a time when the crank angle is further changed by $2\pi/3$.

In the cylinder #2 as shown in FIG. 4 or the cylinder #5 as shown in FIG. 5, an exhaust stroke is not performed for a period after the first 150° BTDC signal is detected and until ignition is performed in the corresponding cylinder. Thus, the fuel supplied to the cylinder #2 or #5 is not exhausted without being subjected to an explosion stroke.

As mentioned above, when the internal combustion engine 10 is operated in the sequence indicated by the time chart shown in FIG. 4 or FIG. 5, the fuel supplied by the NE asynchronous injection is not exhausted without being subjected to an explosion stroke even in the cylinder in which the fuel supplied by the NE synchronous injection is introduced into the combustion chamber 40 at the earliest time. Accordingly, when the internal combustion engine 10 is operated with the sequence indicated by the time chart shown in FIG. 4 or FIG. 5, the fuel supplied by the NE asynchronous injection is not exhausted without being subjected to an explosion stroke even in each of the cylinders.

As mentioned above, when the internal combustion engine 10 is operated with the sequence indicated by the time chart shown in FIG. 4, the fuel supplied by the NE asynchronous injection is first introduced into the combustion chamber 40 of the cylinder #2. In this case, the fuel supplied by the NE asynchronous injection is introduced into the combustion chamber 40 of each of the cylinders in the order "the cylinder #2→ the cylinder #4→ the cylinder #1→ the cylinder #5→ the cylinder #3→ the cylinder #6" in response to changes in the crank angle.

In the internal combustion engine 10, the synchronous ignition can be performed at a time when the first 360° CA signal is detected after the starting operation of the engine is initiated. The time when the first 360° CA signal is detected in the time chart shown in FIG. 4 is substantially coincident with a time when an intake stroke is started in the cylinder #1. Accordingly, when the internal combustion engine 10 is operated with the sequence indicated by the time chart shown in FIG. 4, synchronous injection can be started from the cylinder #1 after the starting operation of the internal combustion engine 10 is initiated.

However, when the internal combustion engine 10 is operated with the sequence indicated by the time chart shown in FIG. 4, the fuel supplied to the cylinder #1 by the NE asynchronous injection has not been introduced into the combustion chamber 40 at a time when the first 360° CA signal is detected. Accordingly, if the fuel is supplied to the cylinder #1 by the synchronous injection by such a timing, the air-fuel mixture introduced into the combustion chamber 40 of the cylinder #1 becomes over-rich when an intake stroke is performed in the cylinder #1.

When the internal combustion engine 10 is operated with the sequence indicated by the time chart shown in FIG. 4, the fuel supplied by the NE asynchronous injection remains in the intake port 42 of each of the cylinders #5, #3 and #6 similar to the intake port 42 of the cylinder #1. Accordingly, it is preferable to wait for the fuel supplied by the synchronous injection until the fuel supplied by the NE asynchronous injection has been consumed for those cylinders.

Indicated by blank arrows in FIG. 4 is a time when synchronous injection is performed when the internal combustion engine 10 is started at a normal temperature. In the system of the present embodiment, when the internal combustion engine 10 is operated along with the sequence indicated by the time chart shown in FIG. 4, the synchronous injection is started from the cylinder which firstly consumes the fuel supplied by the NE asynchronous injection, that is, the cylinder 2. Additionally, the time when the synchronous injection is performed in each of the cylinders is set to be the time corresponding to 120° CA before the corresponding piston 18 reaches the suction TDC. Hereinafter, the crank angle at this time is referred to as 120° BTDC.

When the synchronous injection is started with the cylinder #2 as the initial cylinder, the synchronous injection is performed in the order "the cylinder #2→ the cylinder #4→ the cylinder #1→ the cylinder #5→ the cylinder #3→ the cylinder #6" each time a $2\pi/3$ change is generated in the crank angle with respect to the cylinder in which the fuel supplied by the NE asynchronous injection has been consumed.

Similarly, when the internal combustion engine 10 is operated with the sequence indicated by the time chart shown in FIG. 5, synchronous injection is started from the cylinder which first consumes the fuel supplied by the NE asynchronous injection, that is, the cylinder #5 after the fuel is supplied to each of the cylinders by the NE asynchronous injection. Thereafter, synchronous injection is performed in each of the cylinders in the order "the cylinder #5→ the cylinder #3→ the cylinder #6→ the cylinder #2→ the cylinder #4→ the cylinder #1" each time a $2\pi/3$ change is generated in the crank angle with respect to the cylinder in which the fuel supplied by the NE asynchronous injection has been consumed.

According to the above-mentioned control method, fuel can be sequentially supplied by synchronous injection from the cylinder in which the fuel has been consumed after the fuel has been supplied by the NE asynchronous injection. In this case, the fuel can be supplied to each of the cylinders immediately after the starting operation of the internal combustion engine 10 is started. Additionally, the fuel supplied by asynchronous injection can be prevented from being introduced into the combustion chamber 40 together with the fuel supplied by synchronous injection in each of the cylinders. Thus, according to the internal combustion engine 10, when the temperature of the engine is normal during the starting operation, a good starting characteristic can be obtained without problems such as a deterioration in exhaust emission or an offset in an air-fuel ratio.

Figure 6:
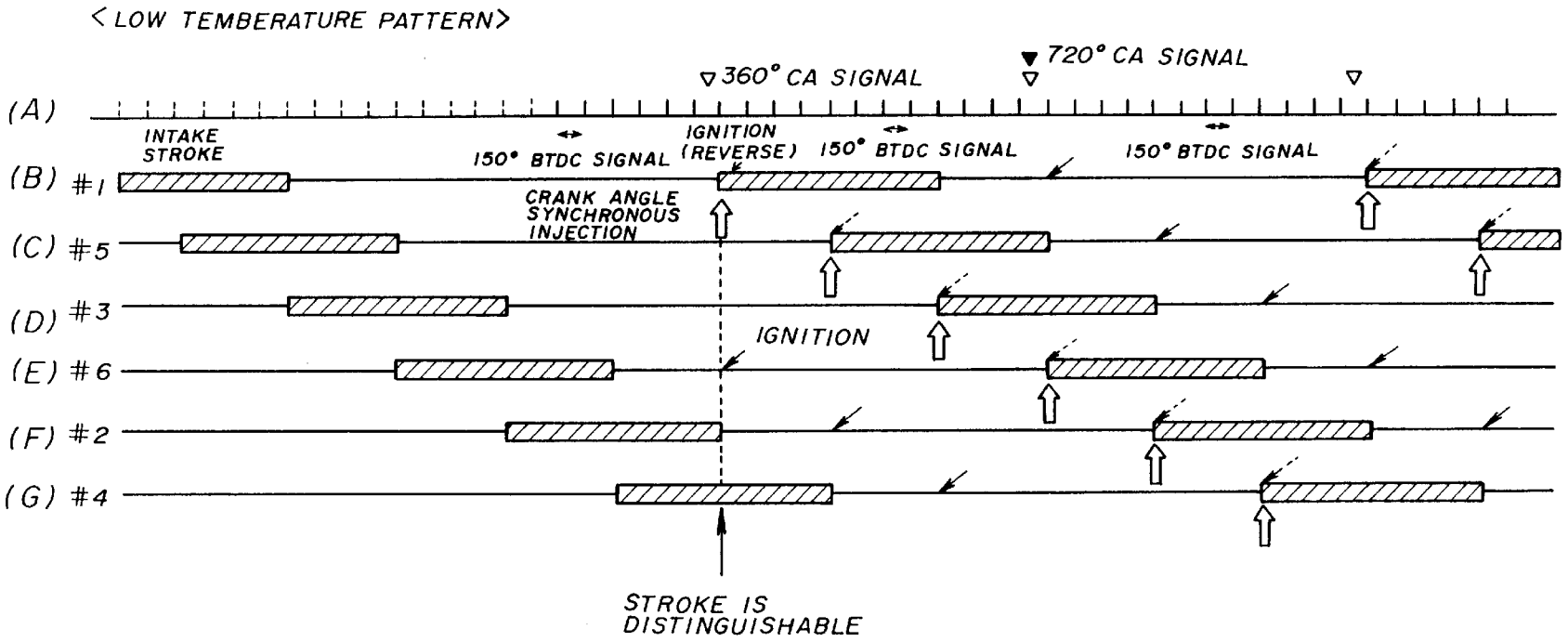
FIG. 6 is a time chart for explaining a fuel injection control operation performed when the internal combustion engine shown in FIG. 1 is restarted.

FIG. 6 is a time chart for explaining a fuel injection control operation performed when the internal combustion engine 10 is restarted. FIG. 6-(A) through FIG. 6-(G) indicate, similar to FIGS. 3, 4 and 5, a time for generating the 30° CA signal and a time for performing the intake stroke in each of the cylinders #1, #5, #3, #6, #2 and #4, respectively.

The internal combustion engine 10 exhibits a good starting characteristic due to a lower starting resistance and good volatility of fuel when it is restarted. Accordingly, when the internal combustion engine 10 is restarted, a sufficiently good starting characteristic can be obtained without performing the asynchronous injection even if the fuel is supplied to each of the cylinders by synchronous injection after a condition is established in which synchronous injection can be performed.

In the system according to the present embodiment, when the internal combustion engine 10 is started, the ECU 12 determines whether or not the starting operation is for a restart of the engine based on the coolant temperature THW and the intake air temperature THA. If it is determined that the internal combustion engine 10 is being restarted, the ECU 12 performs a control to supply fuel to the cylinder in which an intake stroke is being started (the cylinder #1 in FIG. 6) without performing the asynchronous injection at the time when the first 360° CA signal is detected. Thus, when the internal combustion engine 10 is restarted, a good starting characteristic can be obtained without performing an unnecessary asynchronous injection.

A description will now be given, with reference to FIGS. 7 and 8, of an operation of the ECU 12 so as to achieve the above-mentioned functions.

Figure 7:
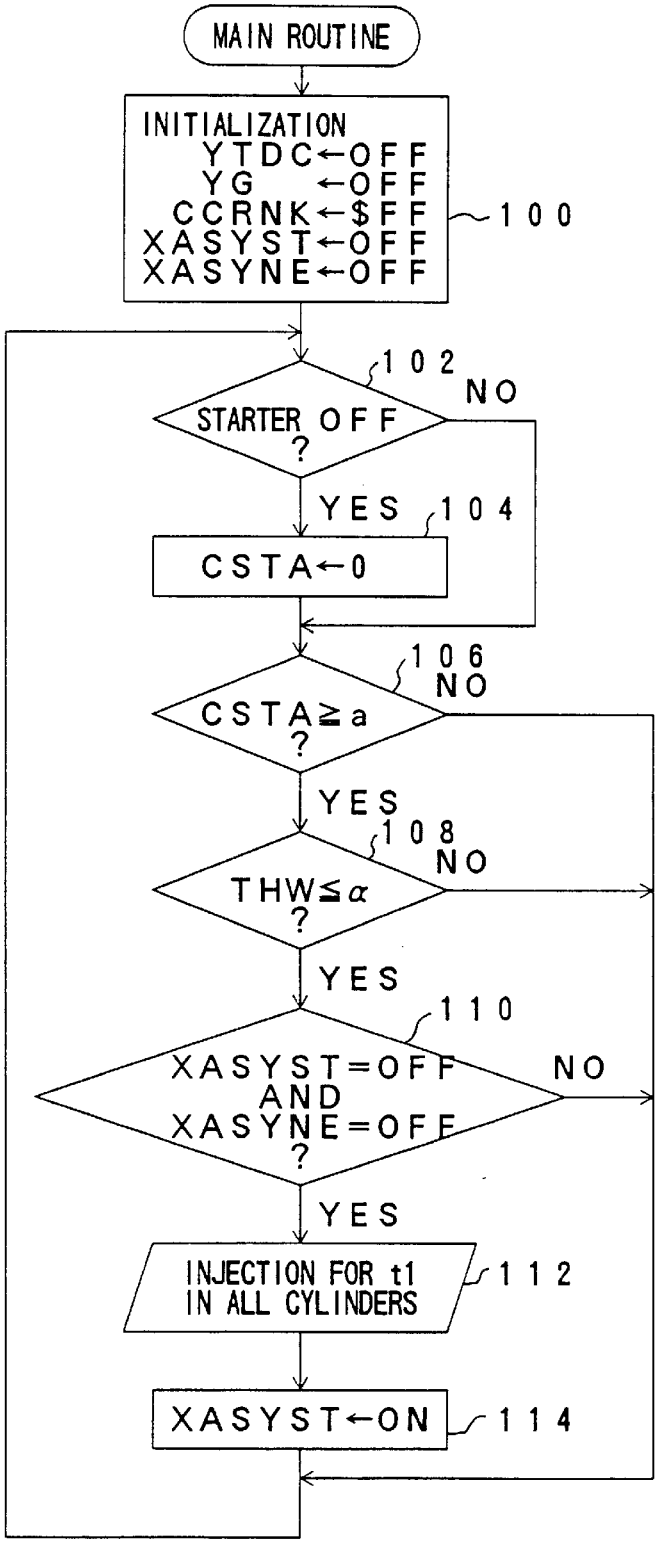
FIG. 7 is a flowchart of a main routine performed by an ECU shown in FIG. 1.

FIG. 7 is a flowchart for a main routine performed by the ECU 12. The routine shown in FIG. 7 is started when the ignition switch of the internal combustion engine 10 is turned on. When the routine shown in FIG. 7 is started, the process of step 100 is performed first.

In step 100, an initialization is performed. Specifically, in this step, 1) a YTDC signal is turned off; 2) a YG signal is turned off; 3) an upper limit value FF is set to a counter CCRNK; 4) a flag XASYST is turned off; 5) a flag XASYNE is turned off.

The YTDC is turned on by the output of the above-mentioned 360° CA signal after a start of the internal combustion engine 10. The YG signal is turned on by the output of the above-mentioned 720° CA signal after a start of the internal combustion engine 10. The counter CCRNK counts the number of 30° CA signals detected after the 360° CA signal is detected. The flag XASYST represents a state of execution of the ST asynchronous injection shown in FIG. 3. The flag XASYNE represents a state of execution of the NE asynchronous injection shown in FIGS. 4 and 5.

After the initialization in step 100 is completed, the process of step 102 is performed.

In step 102, it is determined whether or not the starter switch 82 is turned off. If it is determined that the starter switch 82 is turned off, the process of step 104 is performed. On the other hand, if it is determined that the starter switch is not turned off, the process of step 104 is skipped and the process of step 106 is performed.

In step 104, a counter CSTA is reset to "0". The counter CSTA is automatically incremented toward a predetermined upper limit value after the ignition switch of the internal combustion engine 10 is turned on. After the process of step 104 is completed, the process of step 106 is performed. In the above process, the counter CSTA counts a time after the starter switch 82 is changed from an on state to an off state.

In step 106, it is determined whether or not the value of the counter CSTA is greater than a predetermined value (a).

If CSTA≧a is established, it can be determined that the engine speed NE of the internal combustion engine 10 is increased to a certain level. In this case, the process of step 108 is performed next. On the other hand, if it is determined that CSTA≧a is not established, the routine returns to step 102.

In step 108, it is determined whether or not the coolant temperature THW is less than a predetermined temperature α. The predetermined temperature α is a threshold value for determining whether a temperature of the internal combustion engine 10 is extremely low at a start time of the engine. In the present embodiment, the predetermined temperature α is set to −20° C. (α=−20° C.). If it is determined that THW≦α is established, the process of step 110 is then performed. On the other hand, if it is determined that THW≦α is not established, the routine returns to step 102.

In step 110, it is determined whether or not both the flag XASYST and the flag XASYNE are off. If it is determined that XASYST=OFF and XASYNE=OFF are established, it can be determined that the ST asynchronous injection shown in FIG. 3 and the NE asynchronous injection shown in FIGS. 4 and 5 have not been performed after the starting operation of the internal combustion engine 10 is initiated. In this case, the process of step 112 is performed next. On the other hand, if the above-mentioned condition is not established, the routine returns to step 102.

In step 112, the asynchronous injection of fuel is performed for a predetermined period t1 for all cylinders. The ST asynchronous injection shown in FIG. 3 is achieved by preforming the process of step 112.

In step 114, the flag XASYST is turned on. After the process of step 114 is performed, execution of the ST asynchronous injection is prohibited. After the process of step 114 is completed, the routine returns to step 102.

According to the above-mentioned process, when the temperature of the internal combustion engine 10 is extremely low at the start time and the NE asynchronous injection has not been performed, fuel can be supplied to all cylinders by the ST asynchronous injection for only one time when the predetermined period (a) is passed after the starter switch 82 is turned on.

Figure 8:
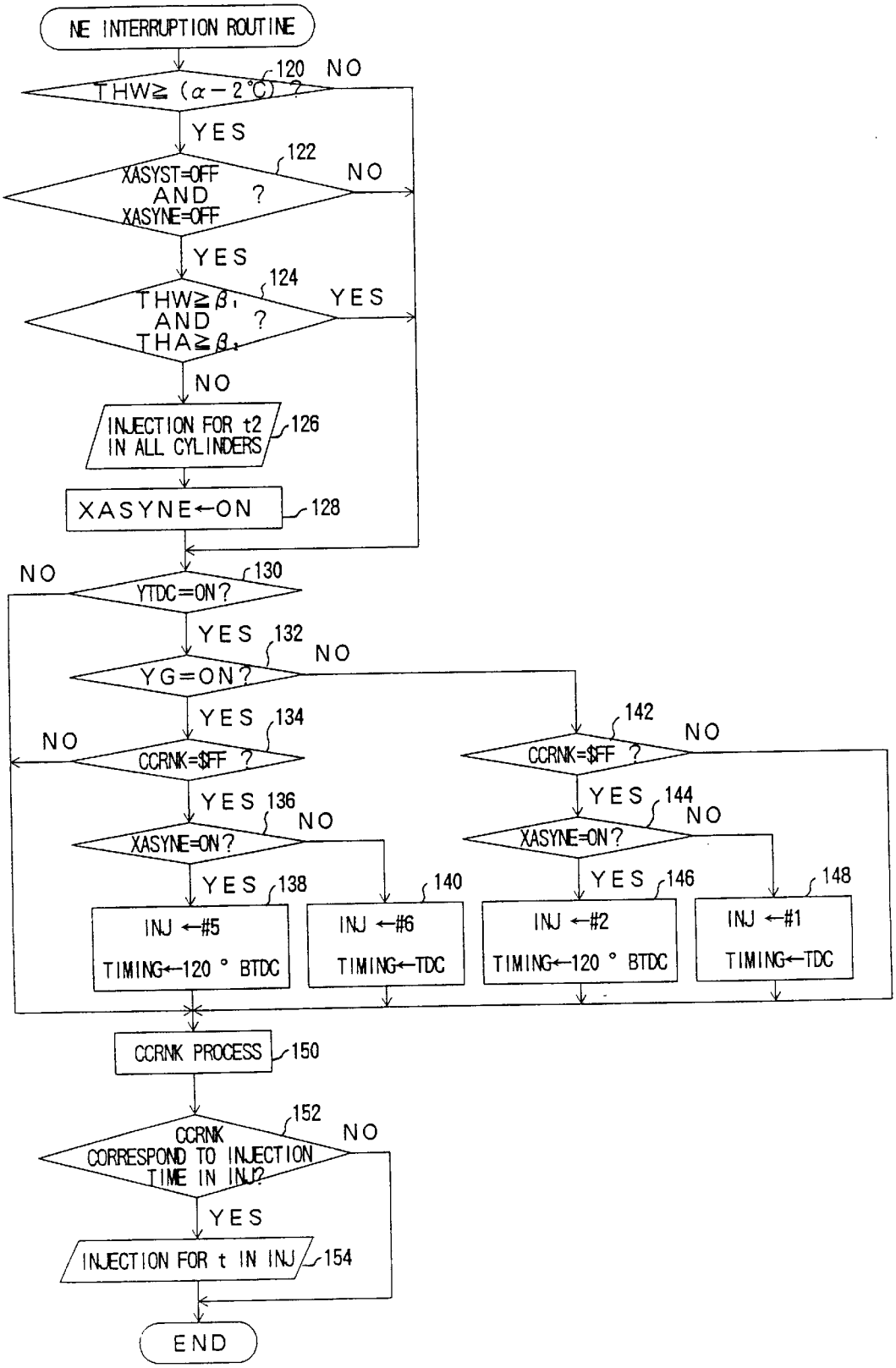
FIG. 8 is a flowchart of an NE interruption routine performed by the ECU shown in FIG. 1 each time a 30° CA signal is detected.

FIG. 8 is a flowchart of a NE interruption routine performed by the ECU 12 each time the 30° CA signal is detected. An execution of the routine shown in FIG. 8 is prohibited after a starting operation of the internal combustion engine 10 is initiated and until the 150° CA signal is detected. Accordingly, the interruption routine shown in FIG. 8 is started at a time when the first 150° CA signal is detected after the starting operation of the internal combustion engine 10 is initiated. When the routine shown in FIG. 8 is started, the process of step 112 is performed first.

In step 120, it is determined whether or not the coolant temperature THW is greater than a predetermined temperature (α−2)° C. As mentioned above, in the present embodiment, the predetermined temperature α is set to −20° C. Specifically, when the coolant temperature is higher than −22° C., if is determined, in step 120, that the THW≧(α−2) is established. In this case, the process of step 122 is then performed. On the other hand, if it is determined that THW≧(α−2) is not established, the processes of steps 122 to 128 are skipped and the process of step 130 is performed next.

In step 122, it is determined whether or not both the flag XASYST and the flag XASYNE are off. The condition of this step is established when the starting operation of the internal combustion engine 10 is initiated and either the ST asynchronous injection or the NE asynchronous injection has not been performed.

As mentioned above, the present routine is started by an interruption process at the time when the first 150° BTDC signal is detected after the starting operation. Additionally, according to the present routine, the NE asynchronous injection is performed during the first interruption process after the starting operation of the internal combustion engine 10 is started under the condition that the ST asynchronous injection has not been performed. Accordingly, if the condition of step 122 is established, it can be determined that the first interruption process is caused by the first 150° BTDC signal and the ST asynchronous injection has not been performed.

In the present routine, if the above-mentioned determination is made in step 122, the process of step 124 is performed next. On the other hand, if it is determined, in step 122, that the above-mentioned condition is not established, the process of steps 122 to 128 is skipped, and then the process of step 130 is performed.

In step 124, it is determined whether or not the coolant temperature THW is higher than a predetermined temperature β1 and the intake air temperature THA is higher than a predetermined temperature β2. The predetermined temperatures β1 and β2 are threshold values for determining whether or not the starting operation of the internal combustion engine 10 is for a restart of the engine. Accordingly, if it is determined that at least one of the relationships THW≧β1 and THW≧β2 is not established, it can be determined that the starting operation at the present time is not a restart, that is, the starting operation at the present time is a regular start. In this case, the process of step 126 is performed next. In the other hand, if it is determined that the above-mentioned condition is not established, it can be determined that the internal combustion engine is subjected to a restart. In such a case, steps 126 and 128 are skipped, and then the process of step 130 is performed.

In step 126, asynchronous injection of fuel is performed for a predetermined period t2 in all cylinders. The NE asynchronous injection is achieved by execution of the process of step 126. After the process of step 126 is completed, the process of step 128 is performed.

In step 128, the flag XASYNE is turned on. After the process of step 128 is completed, the process of step 130 is performed.

In step 130, it is determined whether or not the YTDC signal is turned on. If YTDC=ON is established, it can be determined that at least one 360° CA signal has been detected after the starting operation of the internal combustion engine 10 is initiated. The synchronous injection can be performed when the first 360° CA signal is detected in the internal combustion engine 10. If it is determined, in step 130, that YTDC=ON is established, the process of step 132 and subsequent steps is performed so as to supply fuel by the synchronous injection to an appropriate cylinder at an appropriate time. ON the other hand, if it is determined, in step 130, that YTDC=ON is not established, it can be determined that a condition for starting synchronous injection has not been established. In such a case, steps 132 to 148 are skipped, and the process of step 150 is performed.

In step 132, it is determined whether or not the YG signal is turned on. If it is determined that the YG signal is turned on, it can be determined that at least one 720° CA signal has been detected after the starting operation of the internal combustion engine 10 was initiated. If it is determined that YG=ON is established, the process of step 134 is performed next.

In step 134, it is determined whether or not the upper limit value FF is set to the counter CCRNK. In the present routine, the value of the counter CCRNK is reset to "0" each time the 360° CA signal is detected, and the counter CCRNK is incremented each time the 30° CA signal is detected. Accordingly, the value of the counter CCRNK is maintained at the upper limit value FF after the starting operation of the internal combustion engine 10 is initiated and until the first 360° CA signal is detected.

Additionally, the process of step 134 is performed on the assumption that YTDC=ON is established, that is, the present process cycle was started based on the 360° CA signal. Accordingly, if it is determined, in step 134, that CCRNK=FF is established, it can be determined that the present process cycle was started based on the first 360° CA signal detected after the starting operation of the internal combustion engine 10 was initiated.

Further, the process of step 134 is performed on the condition that YG=ON is established. Accordingly, if it is determined, in step 134, that the CCRNK=FF is established, it can be determined that the present process cycle was started based on the first 360° CA signal detected after the starting operation of the internal combustion engine 10 was started and the 720° CA signal was generated substantially at the same time the 360° CA signal was generated.

If the above-mentioned determination is made in step 134, the process of step 136 is performed next. On the other hand, if it is determined, in step 134, that CCRNK=FF is not established, steps 136 to 140 is skipped and the process of step 150 is performed.

In step 136, it is determined whether or not the flag XASYNE=ON is established. As mentioned above, the flag XASYNE is turned on when the NE asynchronous injection is performed. Additionally, in the present embodiment, the NE asynchronous injection is performed only when the internal combustion engine 10 is started along with the sequence indicated by the time chart shown in FIG. 4 or FIG. 5. Accordingly, if it is determined, in step 136, that XASYNE=ON is established, it can be determined that the internal combustion engine 10 is started along with the sequence indicated by the time chart shown in FIG. 4 or FIG. 5.

The process of step 136 is performed on the condition that the 720° CA signal is detected substantially the same time the first 360° CA signal is detected after the starting operation of the internal combustion engine 10 is initiated. Accordingly, if it is determined, in step 136, that XASYNE=ON is established, it can be determined that the internal combustion engine is operated along with the sequence indicated by the time chart shown in FIG. 5.

As mentioned above, when the internal combustion engine 10 is operated along with the sequence indicated by the time chart shown in FIG. 5, the cylinder to which the fuel supplied by the NE asynchronous injection is introduced first can be distinguished as the cylinder #5. Accordingly if it is determined, in step 136, that XASYNE=ON, it is appropriate to start the synchronous injection from the cylinder #5 and set a time of performing the asynchronous injection to a time corresponding to a position 120° CA before the start of an intake stroke in each of the cylinders, that is, at a time when the crank angle reaches the 120° BTDC.

According to the present routine, if it is determined, in step 136, that XASYNE=ON is established, the process of step 138 is performed.

In step 138, the cylinder from which the synchronous injection is started (hereinafter this cylinder may be referred to as INJ) is set to the cylinder #5, and the time for synchronous injection is set to the 120° BTDC. After the process of step 138 is performed, the internal combustion engine 10 is appropriately operated along with the sequence indicated by the time chart shown in FIG. 5. After the process of step 138 is completed, the process of step 150 is performed next.

As mentioned above, according to the present routine, the NE asynchronous injection is performed at the time when an interruption is permitted and the process for turning on the flag XASYNE is performed, except for cases where 1) the internal combustion engine 10 is started at an extremely low temperature below $(\alpha-2)°$ C.; 2) the ST asynchronous injection is performed prior to the NE asynchronous injection; 3) the starting operation of the internal combustion engine is for a restart of the engine.

Additionally, when the internal combustion engine 10 is started at an extremely low temperature which is below $(\alpha-2)°$ C. (the above-mentioned condition 1), the ST asynchronous injection is always performed prior to the NE asynchronous injection. Accordingly, if it is determined, in step 136, that XASYNE=ON is not established, it can be determined that the internal combustion engine 10 was started with execution of the ST asynchronous injection or the internal combustion engine 10 was started as a restart of the engine.

When the internal combustion engine 10 is started with execution of the ST asynchronous injection (refer to FIG. 3), it is appropriate to set the cylinder #1 or #6 as the cylinder from which the synchronous injection is started and set the time for the synchronous injection to a time substantially equal to the time at which the piston 18 in each of the cylinders reaches top dead center TDC. Similarly, when the internal combustion engine 10 is started as a restart of the engine, it is appropriate to set the cylinder #1 or #6 as the cylinder from which the synchronous injection is started and set the time for the synchronous injection to a time substantially equal to the time at which the piston 18 in each of the cylinders reaches top dead center TDC. Additionally, in these cases, if the first 360° CA signal and the 720° CA signal are detected substantially at the same time, it is appropriate to set the cylinder #6 to be the cylinder from which the synchronous injection is started.

Accordingly, if it is determined, in step 136, that XASYNE=ON is not established, the cylinder #6 is set as the cylinder INJ from which the synchronous injection is started and set the time for performing the synchronous injection to a time when the piston 18 in each of the cylinders reaches the top dead center TDC.

In the present routine, if it is determined, in step 136, that XASYNE=ON is not established, the process of step 140 is performed next.

In step 140, the cylinder INJ is set as the cylinder #6 and the time for performing the synchronous injection to a time when the piston 18 reaches the top dead center TDC in each of the cylinders. After the process of step 140 is performed, the synchronous injection, which is appropriate for starting under an extremely low temperature condition and for a restart of the engine, is performed in the internal combustion engine 10.

In the present routine, if it is determined, in step 132, that YG=ON is not established, the process of step 142 is performed next.

In step 142, it is determined whether or not CCRNK=FF is established. If it is determined that CCRNK=FF is established, it can be determined that the present process cycle is based on the first 360° CA signal detected after the starting operation of the internal combustion engine 10 was initiated and the 720° CA signal was not generated substantially at the same time the 360° CA signal was generated.

If the above-mentioned determination is made in step 142, the process of step 144 is performed next. On the other hand, if it is determined, in step 144, that CCRNK=FF is not established, steps 144 through 148 are skipped and the process of step 150 is performed.

In step 144, it is determined whether or not the Flag XASYNE=ON is established. As mentioned above, the flag XASYNE is turned on when the NE asynchronous injection is performed, that is, when the internal combustion engine 10 is started along with the sequence indicated by the time chart shown in FIG. 3. Additionally, the process of step 144 is performed only when the internal combustion engine 10 is started along with the sequence indicated by the time chart shown in FIG. 4. Accordingly, if it is determined, in step 144, that XASYNE=ON is established, it can be determined that the internal combustion engine 10 is operates along with the sequence indicated by the time chart shown in FIG. 4.

When the internal combustion engine 10 is operates with the sequence indicated by the time chart shown in FIG. 4, it is appropriate that the cylinder #2 is set as the cylinder INJ from which the synchronous injection is started and the time for performing the asynchronous injection in each of the cylinders is set to a time corresponding to the crank angle 120° CA before an intake stroke is started, that is, a time when the crank angle reaches 120° BTDC.

According to the present routine, if XASYNE=ON is established in step 144, the process of step 146 is performed next.

In step 146, the cylinder #2 is set as the cylinder INJ from which the synchronous injection is started and the time for performing the synchronous injection is set as 120° BTDC. After the process of step 146 is performed, the internal combustion engine 10 is operated along with the sequence indicated by the time chart shown in FIG. 4. After the process of step 146 is completed, the process of step 150 is performed.

In the present routine, if it is determined, in step 144, that XASYNE=ON is not established, it can be determined that the internal combustion engine 10 was started with execution of the ST asynchronous injection or the internal combustion engine was started as a restart of the engine.

When the internal combustion engine 10 is started with execution of the ST asynchronous injection (refer to FIG. 3), it is appropriate that the cylinder #1 or #6 is set as the cylinder INJ from which synchronous injection is started and a time for performing the synchronous injection is set to a time when the piston 18 reaches the top dead center TDC in each of the cylinders. Similarly, when the internal combustion engine 10 is started as a restart of the engine (refer to FIG. 6), it is also appropriate that the cylinder #1 or #6 is set as the cylinder INJ from which synchronous injection is started and a time for performing the synchronous injection is set to a time when the piston 18 reaches the top dead center TDC in each of the cylinders. Additionally, in these cases, when the first 360° CA signal is detected alone without being accompanied by the 720° CA signal, it is appropriate to set the cylinder #1 as the cylinder INJ from which the synchronous injection is started.

Accordingly, if it is determined, in step 144, that XASYNE=On is not established, it is appropriate that the cylinder #1 is set as the cylinder INJ from which synchronous injection is started and a time for preforming the synchronous injection in each of the cylinders is set to a time when the piston 18 reaches the top dead center TDC.

In the present routine, if it is determined, in step 144, that XASYNE=ON is not established, the process of step 148 is performed next.

In step 148, the cylinder #1 is set as the cylinder INJ from which synchronous injection is started, and the time for performing the synchronous injection is set to a time when the position 18 reaches top dead center TDC in each of the cylinders. After the process of the step 148 is performed, the internal combustion engine 10 is operated along with the sequence indicated by the tine chart shown in FIG. 3 or FIG. 6 while performing synchronous injection which is appropriate for starting under an extremely low temperature condition and a restart of the engine.

In the present routine, a process related to the counter CCRNK is performed in step 150. Specifically, the counter CCRNK is set to "0" when the present process cycle is based on the 360° CA signal. On the other hand, if the present process cycle is based on other 30° CA signals, the counter CCRNK is incremented. After the process of step 150 is completed, the process of step 152 is performed next.

In step 152, it is determined whether or not the count value of the counter CCRNK in coincident with the time for preforming synchronous injection. If it is determined that count value of the counter CCRNK is coincident with the time for performing the synchronous injection, the process of step 154 is performed next. On the other hand, if a result of the determination is negative, the routine is immediately ended.

In step 154, fuel is injected to the cylinder to which the synchronous injection is to be performed for a predetermined period "t". The asynchronous injection shown in FIGS. 3 through 6 is achieved by performing the process of step 154. After the process of step 154 is completed, the routine is ended.

As mentioned above, according to the routine shown in FIGS. 7 and 8, the internal combustion engine 10 can be operated along with the sequences indicated by the time charts shown in FIGS. 3 through 6 in response to the circumstance of a starting operation of the internal combustion engine 10. Thus, in the internal combustion engine 10, the following advantages can be obtained:

1) a good start characteristic is provided when a temperature of the engine is extremely low;
2) a good start characteristic is provided while an exhaust emission and an air-fuel ratio are appropriately maintained when the engine is at a normal temperature; and
3) a superior start characteristic can be provided without unnecessary asynchronous injection.

It should be noted that the crank angle sensor 34 corresponds to the "first reference signal generating means" and the "crank angle signal generating means"; the cam position sensor 62 corresponds to the "second reference signal generating means". Additionally, the "first asynchronous injection means" is achieved by the ECU 12 performing the process of step 126; the "synchronous injection means" is achieved by the ECU 12 performing the process of steps 150 through 154; the "first start cylinder setting means" is achieved by the ECU 12 performing the process of steps 130, 132, 138 and 146.

Additionally, in the above-mentioned embodiment, the water temperature sensor 36 and the intake air temperature sensor 69 correspond to the "start temperature detecting means". The "second asynchronous injection means" is achieved by the ECU 12 performing the process of step 112;

the "second start cylinder setting means" is achieved by the ECU 12 performing the process of steps 140 and 148; the "operation switching means" is achieved by the ECU 12 performing the process of steps 124, 128, 136 and 144.

A description will now be given, with reference to FIGS. 9 through 11, of a second embodiment of the present invention. A fuel injection control system according to the second embodiment of the present invention is achieved by using the system structure shown in FIG. 1 in which the ECU 12 preforms the main routine shown in FIG. 7 and also performs a control routine shown in FIG. 9 instead of the control routine shown in FIG. 8.

As mentioned above, according to the system of the first embodiment, the internal combustion engine 10 is operated with the sequence indicated by the time chart shown in FIG. 4 or FIG. 5 when the internal combustion engine is at a normal temperature. In such a case, the NE asynchronous injection is performed in all cylinders when the first 150° BTDC signal is detected after a starting operation of the internal combustion engine 10 is initiated.

In the time chart shown in FIG. 4 or 5, the time when the first 150° BTDC signal is detected, after initiation of the starting operation of the internal combustion engine 10, is coincident with a time immediately before an intake stroke in the cylinder #6 is completed (refer to FIG. 4) or a time immediately before an intake stroke in the cylinder #1 is completed (refer to FIG. 5). Accordingly, the fuel supplied to these cylinders by the NE asynchronous injection remains inside the intake port 42 until a next suction stroke is performed in the corresponding cylinders.

When the internal combustion engine 10 is operated with the sequence indicated by the time chart shown in FIG. 4, the intake stroke for introducing the fuel supplied by the NE asynchronous injection into the cylinder #6 is performed after establishing a condition in which the synchronous injection is permitted. Similarly, when the internal combustion engine 10 is operated with the sequence indicated by the time chart shown in FIG. 5, the intake stroke for introducing the fuel supplied by the NE asynchronous injection into the cylinder #1 is performed after establishing a condition in which the synchronous injection is permitted.

Accordingly, for these cylinders, the first explosion stroke can be performed at a timing similar to a case in which fuel is supplied by the NE asynchronous injection by supplying fuel by synchronous injection immediately before an intake stroke is started. Additionally, if the fuel supplied to these cylinders for the first time is supplied not by the NE asynchronous injection and by the synchronous injection, the problem of fuel remaining in the intake port 42 of the cylinder #1 and #6 for a relatively long time can be avoided.

The fuel injection control system according to the present embodiment performs the first fuel supply for the cylinders #1 and #6 by synchronous injection when the internal combustion engine 10 is started at a normal temperature.

Figure 9:
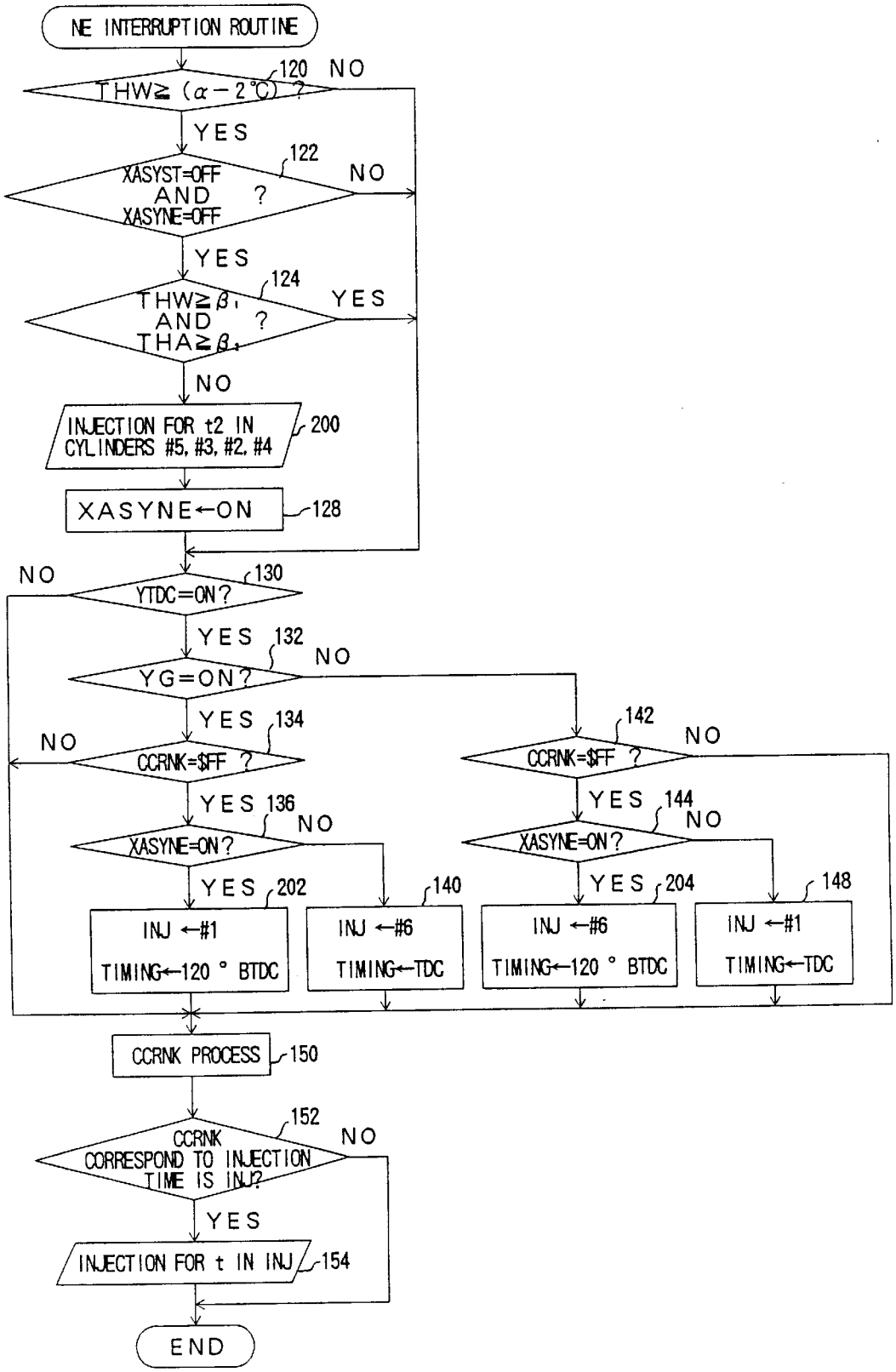
FIG. 9 is an NE interruption routine performed by a fuel injection control system according to a second embodiment of the present invention.

FIG. 9 is a flowchart of a control routine performed by the ECU 12 so as to achieve the above-mentioned function. Similar to the routine shown in FIG. 8., the routine shown in FIG. 9 is an NE interruption routine performed each time the 30° CA signal is detected after the 150° BTDC signal after the starting operation of the internal combustion engine 10 is initiated. It should be noted that, in FIG. 9, steps the same as the steps shown in FIG. 8 are given the same reference numerals, and descriptions thereof will be omitted.

When the first 150° CA signal is detected after a starting operation of the internal combustion engine 10 is initiated, the routine shown in FIG. 9 is started. At this time, the process of step 200 is performed subsequent to step 124 if the following conditions are met: 1) a coolant temperature THW is higher than (α−2)° C. (step 120); 2) the ST asynchronous injection has not been performed (step 122): and 3) the coolant temperature THW and an intake air temperature THA do not satisfy a high temperature condition.

In step 200, asynchronous injection is performed for a period t2 in the cylinders #5, #3, #2 and #4. In the routine shown in FIG. 9, the NE asynchronous injection is achieved by performing the process of step 200 when the first 150° BTDC signal is detected.

When the process of step 200 is performed in step 200, the process cycle based on the first 150° BTDC signal after the flag XASYNE is performed (step 128) is ended. On the other hand, if the ST asynchronous injection has already been performed at the time when the first 150° BTDC signal is detected, or one of the THW and THA satisfies the high temperature condition, the flag XASYNE is not turned on and the process cycle based on the first 150° BTDC signal is ended.

When the first 360° CA signal is detected together with the 720° CA signal after the starting operation of the internal combustion engine 10 is initiated, the process of step 136 is performed via the steps 130 through 134.

In step 136, it is determined whether or not XASYNE=ON is established. If it is determined that XASYNE=ON is established, it can be determined that the NE asynchronous injection has been performed in each of the cylinders #5, #3, #2 and #4. That is, it can be determined that the internal combustion engine was started under a normal temperature condition. In this case, the process of step 202 is performed next. On the other hand, if it is determined that the XASYNE=ON is not established, it can be determined that the internal combustion engine 10 is being started under an extremely low temperature condition, or an attempt is being made to restart the internal combustion engine 10. In this case, a process similar to the process in the routine shown in FIG. 8 is performed subsequently.

In step 202, the cylinder #1 is set as the cylinder INJ from which the synchronous injection is started. Additionally, the time for performing the synchronous injection is set to a time corresponding to 120° CA before the piston 18 in each of the cylinder reaches the top dead center TDC, that is, a time when the crank angle reaches 120° BTDC. After the process of step 202 is completed, a process similar to the process of the routine shown in FIG. 8 is performed.

When the first 360° CA signal is detected alone without the 720° CA signal, the process of step 144 is performed via steps 130, 132 and 142.

In step 144, it is determined whether or not XASYNE=ON is established. If it is determined that XASYNE=ON is established, it can be determined that the NE asynchronous injection has been performed in each of the cylinders #5, #3, #2 and #4. That is, it can be determined that the internal combustion engine was started under a normal temperature condition. In this case, the process of step 204 is performed next. On the other hand, if it is determined that the XASYNE=ON is not established, it can be determined that the internal combustion engine 10 is being started under an extremely low temperature condition, or an attempt is being made to restart the internal combustion engine 10. In this case, a process similar to the process in the routine shown in FIG. 8 is performed subsequently.

In step 204, the cylinder #6 is set as the cylinder INJ from which synchronous injection is started. Additionally, the time for performing synchronous injection is set to a time corresponding to 120° CA before the piston 18 in each cylinder reaches the top dead center TDC, that is, a time when the crank angle reaches 120° BTDC. After the process of step 202 is completed, a process similar to the process of the routine shown in FIG. 8 is performed.

Figure 10:
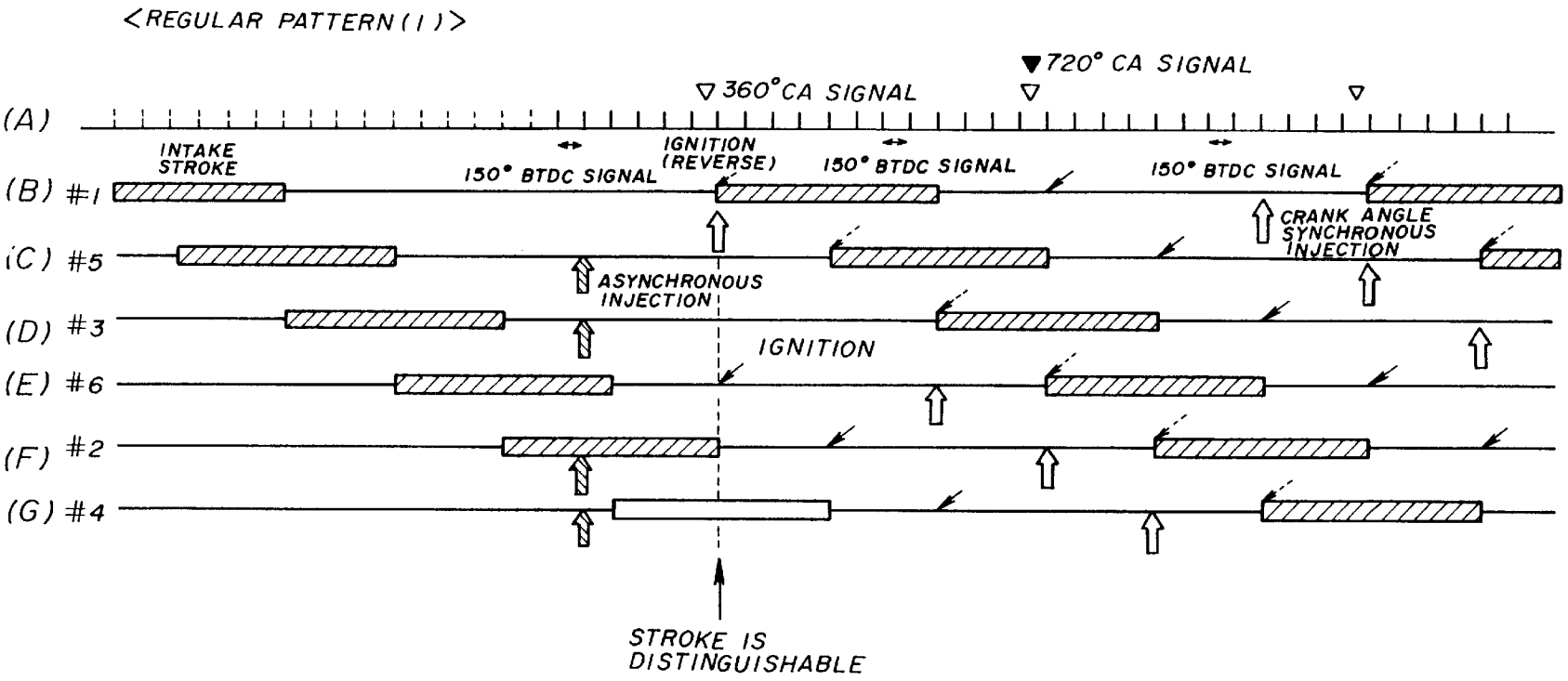
FIG. 10 is a time chart for explaining a fuel injection control operation performed in the second embodiment when an internal combustion engine is at a room temperature during a starting operation.
Figure 11:
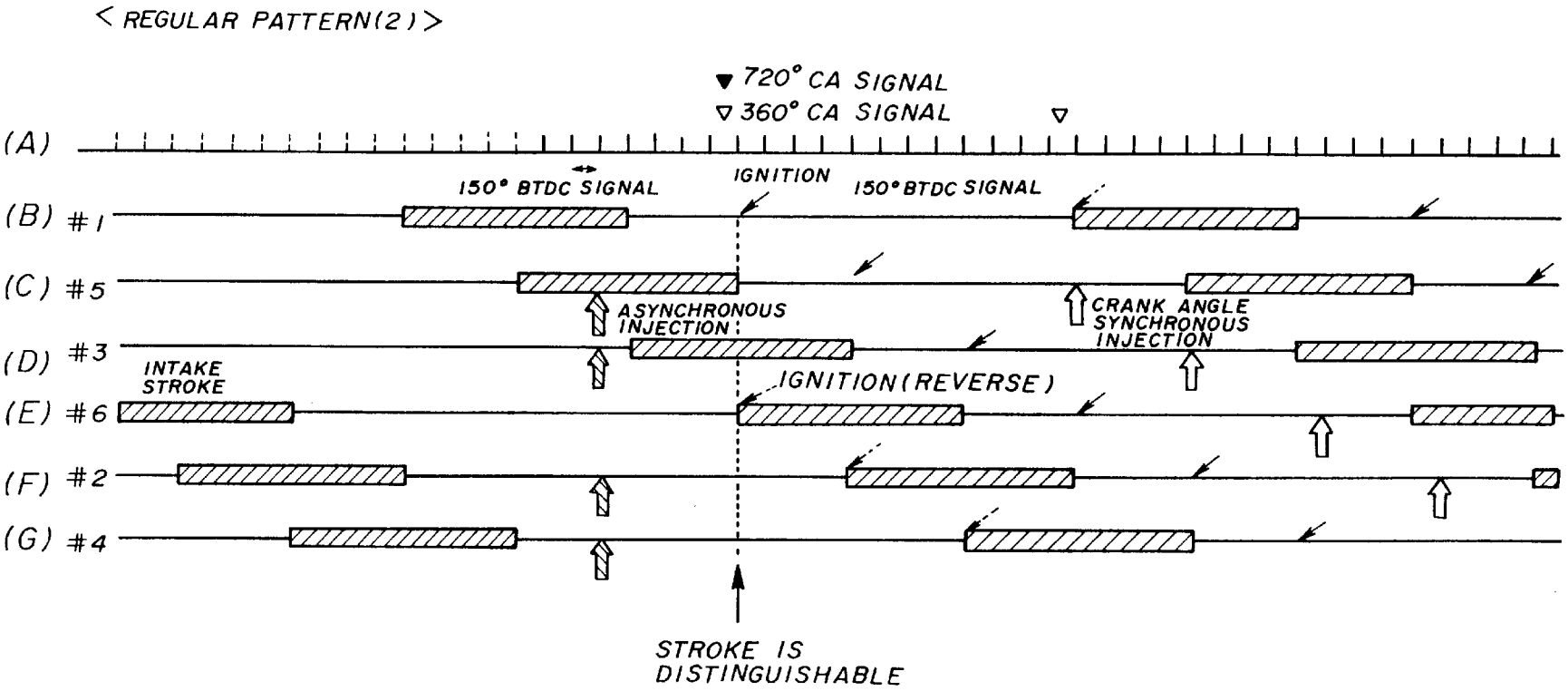
FIG. 11 is a time chart for explaining another fuel injection control operation performed in the second embodiment when an internal combustion engine is at a room temperature during a starting operation.

FIGS. 10 and 11 are time charts for explaining a fuel injection control operation when the routine shown in FIG. 9 is performed by the ECU 12. Specifically, the time chart of FIG. 10 shows an operation performed when the first 360° CA signal is detected alone without the 720° CA signal. On the other hand, the time chart of FIG. 5 shows an operation performed when the first 360° CA signal is detected substantially at the same time the 720° CA signal is detected. It should be noted that FIG. 10-(A) through FIG. 10-(G) and FIG. 11-(A) through FIG. 11-(G) indicate a time for generating the 30° CA signal and a time for performing an intake stroke in each of the cylinders #1, #5, #3, #6, #2 and #4, respectively.

A shown in FIGS. 10 and 11, according to the routine shown in FIG. 9, supply of fuel is prevented from being performed with respect to the cylinder (the cylinder #6 in FIG. 10 and the cylinder #1 in FIG. 11) in which an intake stroke is being completed when the first 150° CA signal is detected after the internal combustion engine 10 is started. Then, fuel can be immediately supplied to these cylinders by synchronous injection. Thus, according to the present embodiment, a good start characteristic can be obtained without the fuel supplied by the NE asynchronous injection remaining in the intake port 42.

It should be noted that, in the present embodiment, the "first asynchronous injection means" is achieved by the ECU 12 performing the process of step 200, and the "first start cylinder setting means" is achieved by the ECU 12 preforming the process of steps 130, 132, 202 and 204.

In the above-mentioned embodiment, when the internal combustion engine 10 is started under an extremely low temperature condition and when the NE asynchronous injection is not performed for one of the first group of cylinders #1 and #6 in which an intake stroke is ended at the time when the first 150° BTDC signal is detected (this cylinder is referred to as an intake complete cylinder), the NE asynchronous injection is also not performed in the other one of the first group of cylinders #1 and #6 (this cylinder is referred to as a pair cylinder). Additionally, in the above-mentioned embodiment, the cylinder from which synchronous injection is started when the internal combustion engine 10 is started under a normal temperature condition is set as the intake complete cylinder. Thus, fuel may not be introduced into the pair cylinder by the first suction stroke.

In FIG. 10, the intake stroke in the cylinder #1 which is the pair cylinder is started substantially in synchronization with a time when a start of the synchronous injection is enabled. Similarly, in FIG. 10, the intake stroke in the cylinder #6 which is the pair cylinder is started substantially in synchronization with a time when a start of synchronous injection is enabled. Accordingly, if the time for performing the synchronous injection is set to a time when the piston in the pair cylinder reaches the suction TDC, fuel can be supplied to the pair cylinder by synchronous injection before the first suction stroke is started. Thus, the start characteristic of the internal combustion engine 10 can be further improved by supplying fuel to the pair cylinder by synchronous injection when the first 360° CA signal is detected.

The present invention is not limited to the specifically disclosed embodiments, and variations and modifications may be made without departing from the scope of the present invention.

What is claimed is:

1. A fuel injection control system for an internal combustion engine having a plurality of cylinders, said fuel injection control system controlling a time for injecting fuel into each of the cylinders, said fuel injection control system comprising:

first reference signal generating means for generating a first reference signal each time a crank shaft of said internal combustion engine rotates 360 degrees;

second reference signal generating means for generating a second reference signal each time said crank shaft rotates 720 degrees;

crank angle signal generating means for generating a crank angle signal each time said crank shaft rotates a first predetermined angle;

first asynchronous injection means for supplying fuel to said cylinders after said first reference signal is generated for the first time after said internal combustion engine is started;

synchronous injection means for sequentially supplying fuel into each of said cylinders in a predetermined order in synchronization with a rotation of said crank angle;

first start cylinder setting means for assuming one of said cylinders in which the fuel supplied by said first asynchronous injection means is consumed for the first time, and for setting said one of said cylinders as a cylinder from which the synchronous injection is started, an assumption of said one of said cylinders being made based on a determination of whether said second reference signal is generated while said crank shaft rotates a second predetermined angle after said first reference signal is generated for the first time.

2. The fuel injection control system as claimed in claim 1, further comprising:

start temperature detecting means for detecting a temperature of said internal combustion engine at a start time;

second asynchronous injection means for supplying fuel to all of said cylinders at a predetermined time after a start operation of said internal combustion engine is initiated, said first asynchronous injection means being ineffective when said second asynchronous injection means is effective;

second start cylinder setting means for assuming one of said cylinders which can intake fuel at the earliest time after said crank shaft rotates said second predetermined angle, and for setting said one of said cylinders as a cylinder from which the synchronous injection is started, said first start cylinder setting means being ineffective when said second start cylinder setting means is effective; and operation switching means for effectuating one of said first asynchronous injection means and said second asynchronous injection means which can supply fuel earlier when the temperature of said internal combustion engine is lower than a predetermined temperature at the start time, and for effectuating said second start cylinder setting means instead of said first start cylinder setting means when the temperature of said internal combustion engine is lower than said predetermined temperature at the start time.

3. The fuel injection control system as claimed in claim 1, wherein said crank angle signal generating means generates the crank angle signal each time said crank shaft rotates 30 degrees.

4. The fuel injection control system as claimed in claim 1, wherein said first reference signal generating means comprises a crank angle sensor detecting an angular position of said crank shaft, and said second reference signal generating means comprises a cam position sensor detecting a predetermined angular position of a cam shaft of said internal combustion engine.

5. The fuel injection control system as claimed in claim 1, further comprising prohibiting means for prohibiting said first asynchronous injection means from supplying fuel to at least one of said cylinders in which an intake stroke is being completed.

* * * * *